US010626001B2

(12) United States Patent
Lager

(10) Patent No.: US 10,626,001 B2
(45) Date of Patent: Apr. 21, 2020

(54) PUNCTURE DEVICE FOR AN ARRAY OF BEVERAGE CONTAINERS

(71) Applicant: Lucky Lager, LLC, Las Vegas, NV (US)

(72) Inventor: Timothy Lager, Las Vegas, NV (US)

(73) Assignee: LUCKY LAGER, LLC, Las Vegas, NV (US)

( * ) Notice: Subject to any disclaimer, the term of this patent is extended or adjusted under 35 U.S.C. 154(b) by 0 days.

(21) Appl. No.: 16/228,672

(22) Filed: Dec. 20, 2018

(65) Prior Publication Data

US 2019/0202678 A1 Jul. 4, 2019

Related U.S. Application Data

(60) Provisional application No. 62/611,468, filed on Dec. 28, 2017.

(51) Int. Cl.
*B67B 7/00* (2006.01)

(52) U.S. Cl.
CPC ..... *B67B 7/24* (2013.01)

(58) Field of Classification Search
CPC ..... B67B 7/24
USPC ..... 222/80–83; 141/330
See application file for complete search history.

(56) References Cited

U.S. PATENT DOCUMENTS 514,014 A * 2/1894 Low ..... B67B 7/24 30/414
919,675 A * 4/1909 Armstrong ..... B67B 7/24 220/277
1,082,426 A * 12/1913 Keith ..... B67B 7/24 220/278
2,037,410 A * 4/1936 Ernst ..... B67B 7/24 30/447
2,284,066 A * 5/1942 Ostrander ..... B67B 7/24 30/447
2,520,068 A * 8/1950 Seiler ..... B67B 7/24 222/83
2,547,556 A * 4/1951 Benigar ..... B67B 7/28 222/83
2,576,926 A * 12/1951 Donnelly ..... B67B 7/24 30/448
2,579,912 A * 12/1951 Donnelly ..... B67B 7/24 30/448
2,607,511 A * 8/1952 Uljak ..... B67B 7/26 222/83
2,622,317 A * 12/1952 Friend ..... B67B 7/24 30/447
2,690,006 A * 9/1954 Armstrong ..... B67B 7/24 30/447

(Continued)

*Primary Examiner* — Patrick M. Buechner
*Assistant Examiner* — Michael J. Melaragno
(74) *Attorney, Agent, or Firm* — Brownstein Hyatt Farber Schreck, LLP

(57) ABSTRACT

Embodiments are directed to a puncture device that is adapted to puncture an array of beverage cans with a single actuation. A pivot arm rotates relative to a base that holds the array of beverage cans. The arm may include teeth that may be advanced or pushed into the array of beverage cans when the arm is rotated, thereby forming auxiliary openings in each of the cans. The punctured cans may be removed from the device and opened by a tab at a top end. This may create a vent that allows fluid to quickly expel from the auxiliary opening.

20 Claims, 15 Drawing Sheets

(56) References Cited

U.S. PATENT DOCUMENTS 2,690,615 A * 10/1954 Lane ..... B67B 7/24 30/447
2,721,380 A * 10/1955 Gagnon ..... B67B 7/24 30/447
2,725,622 A * 12/1955 Geier ..... B67B 7/24 30/447
2,747,272 A * 5/1956 Smith ..... B67B 7/24 30/447
3,081,539 A * 3/1963 Daniely ..... B67B 7/24 30/447
3,152,395 A * 10/1964 Turner ..... B67B 7/24 30/448
3,263,326 A * 8/1966 Walter, Jr. ..... B67B 7/24 222/82
3,296,696 A * 1/1967 Kamla ..... B26F 1/36 30/363
3,438,548 A * 4/1969 Ceyba ..... B09B 3/0058 222/80
3,828,976 A * 8/1974 Sidelinker ..... B09B 3/0058 222/83.5
4,126,160 A * 11/1978 Gurtler ..... B30B 9/321 100/902
4,205,757 A * 6/1980 Jurgens ..... B67B 7/26 222/83
4,932,130 A * 6/1990 Hollander ..... B67B 7/24 30/450
5,067,529 A * 11/1991 Gonzalez-Miller ..... B09B 3/0058 100/104
5,125,536 A * 6/1992 Winder ..... B67B 7/24 141/330
5,823,236 A * 10/1998 Kirby ..... B67B 7/28 141/330
9,260,282 B2 * 2/2016 Laverty ..... B67B 7/24
9,845,232 B2 * 12/2017 Campbell ..... B09B 3/0058
2004/0056033 A1 * 3/2004 Bohlman ..... B67B 7/24 220/278
2014/0069065 A1 * 3/2014 Laverty ..... B67B 7/24 53/492
2015/0298955 A1 * 10/2015 Campbell ..... B09B 3/0058 141/330
2018/0334370 A1 * 11/2018 Harlow ..... B67B 7/24
2019/0069700 A1 * 3/2019 Stirbis ..... A47G 19/22
2019/0202678 A1 * 7/2019 Lager ..... B67B 7/24

* cited by examiner

PUNCTURE DEVICE FOR AN ARRAY OF BEVERAGE CONTAINERS

CROSS REFERENCE TO RELATED APPLICATION

This application is a non-provisional patent application of and claims the benefit of U.S. Provisional Patent Application No. 62/611,468, filed Dec. 28, 2017 and titled "Puncture Device for an Array of Beverage Containers," the disclosure of which is hereby incorporated herein by reference in its entirety.

FIELD

The described embodiments relate generally to a puncturing device and methods of use. More particularly, the present embodiments relate to a mechanism and structures that facilitate puncturing an array of beverage cans.

BACKGROUND

Canned beverages are generally available for purchase in restaurants and bars and may be marketed or sold according to their brand or individual labeling. Canned beverages are typically consumed by popping a tab or opening formed in the top of the can. However, in order to generate additional interest at a bar or restaurant, it may be advantageous to provide a machine or system that enables or encourages groups of people to order and consume canned beverages in a non-conventional manner. The embodiments described herein are directed to a system for puncturing an array of beverage containers for consumption by a group of patrons.

SUMMARY

Embodiments of the present disclosure are directed to a puncture device for puncturing a sidewall of multiple cans.

In a first aspect, the present disclosure includes a puncture device for producing an auxiliary opening in a beverage can. The puncture device includes a base configured position an array of beverage cans. Each beverage can of the array of beverage cans is positioned in an inclined orientation with a top end of the beverage can positioned lower than a bottom end of the beverage can. The puncture device further includes an arm pivotally coupled to the base. The arm includes an array of puncture teeth. Each puncture tooth of the array of puncture teeth is configured to be positioned above a respective beverage can of the array of beverage cans. The arm is configured to be manually rotated relative to the base to drive each puncture tooth of the array of puncture teeth into the respective beverage can to produce the auxiliary opening located proximate to the bottom end of the respective beverage can.

In a second aspect, the present disclosure includes a puncture device system. The puncture device system includes a puncture device that includes a base defining a cavity and an arm pivotally coupled to the base. The arm comprises a first puncture tooth and a second puncture tooth. The puncture device system further includes a first beverage can that includes a first tab positioned at a top end of the first beverage can. The first beverage can is positioned in the cavity and aligned with the first puncture tooth. The puncture device system further includes a second beverage can that includes a second tab positioned at a top end of the second beverage can. The second beverage can is positioned in the cavity and aligned with the second puncture tooth. The arm is configured to be manually rotated relative to the base to drive the first puncture tooth into the first beverage can to produce a first auxiliary opening located proximate to a bottom end of the first beverage can and a second auxiliary opening located proximate to a bottom end of the second beverage can.

In a third aspect, the present disclosure includes a method for producing auxiliary openings in an array of beverage cans. The method includes positioning the array of beverage cans in a cavity of a base. The positioning the array of beverage cans comprises, for each beverage can in the array of beverage cans, positioning a bottom end of the beverage can in a front locating feature of the base and positioning a top end of the beverage can in a rear locating feature of the base. The top end of the beverage can is positioned lower than the bottom end of the beverage can. The method further includes manually rotating an arm relative to the base to drive a puncture tooth of an array of puncture teeth into a respective beverage can to produce an auxiliary opening located proximate to the bottom end of the respective beverage can.

In addition to the exemplary aspects and embodiments described above, further aspects and embodiments will become apparent by reference to the drawings and by study of the following description.

BRIEF DESCRIPTION OF THE DRAWINGS

The disclosure will be readily understood by the following detailed description in conjunction with the accompanying drawings, wherein like reference numerals designate like elements.

Figure 1:
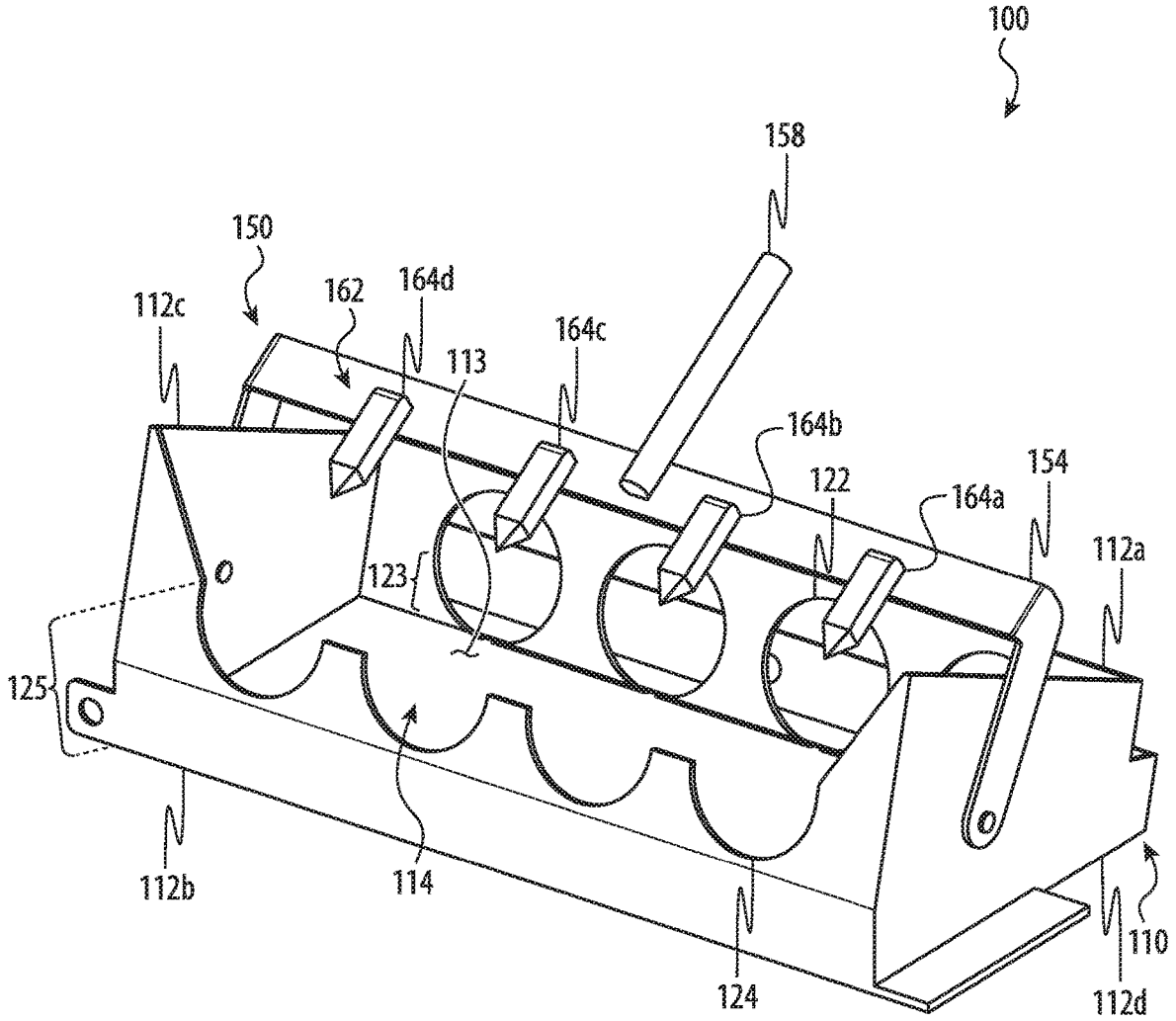
FIG. 1 depicts an example puncture device.

The use of cross-hatching or shading in the accompanying figures is generally provided to clarify the boundaries between adjacent elements and also to facilitate legibility of the figures. Accordingly, neither the presence nor the absence of cross-hatching or shading conveys or indicates any preference or requirement for particular materials, material properties, element proportions, element dimensions, commonalities of similarly illustrated elements, or any other characteristic, attribute, or property for any element illustrated in the accompanying figures.

Additionally, it should be understood that the proportions and dimensions (either relative or absolute) of the various features and elements (and collections and groupings thereof) and the boundaries, separations, and positional relationships presented therebetween, are provided in the accompanying figures merely to facilitate an understanding of the various embodiments described herein and, accordingly, may not necessarily be presented or illustrated to scale, and are not intended to indicate any preference or requirement for an illustrated embodiment to the exclusion of embodiments described with reference thereto.

DETAILED DESCRIPTION

The description that follows includes sample systems, methods, and apparatuses that embody various elements of the present disclosure. However, it should be understood that the described disclosure may be practiced in a variety of forms in addition to those described herein.

The present disclosure is directed to systems and structures that facilitate consumption of multiple canned beverages by a group of people. More specifically, the present disclosure relates to a puncture device that creates an auxiliary opening in a sidewall of each of an array of beverage cans. The contents of the beverage can be consumed rapidly through the auxiliary opening by forming a top opening, such as by popping a tab at the top of the can. The top opening serves as a vent and allows the beverage to flow quickly out of the auxiliary opening.

For purposes of the following description, a beverage can or "can" may be used to refer to a beverage container having thin sidewalls and configured to hold a volume of fluid. The can may be generally cylindrical in shape and define a top and a bottom end. In some cases, the can includes an extruded, monolithic bottom portion and a cap at a top end. The container may be formed from a metal material, such as aluminum, steel, or tin. However, in some cases, the can may include or be formed using non-metallic materials, including polymers, plastics, or a composite material. The fluid or beverage held within the container may be sealed from an external environment and, in some cases, pressurized or carbonated. The container may include a tab or other opening feature along a top surface that, when engaged, creates a top opening. The container may be held in an upright position and subsequently poured from the top opening for consumption by a patron. However, a single top opening may limit a rate at which fluid may be consumed. Also, traditional canned beverages are relatively commonplace and do not generate a heightened interest when served in a bar or restaurant.

The puncture device of the present disclosure may solve some of these issues with traditional canned beverages by allowing for a non-traditional consumption by a group of people. For example, the puncture device may be configured to create an auxiliary hole in a sidewall of each of an array of beverage cans. The puncture device may create each of the auxiliary holes in the array of beverage cans in a substantially simultaneous fashion by a single actuation of the device. The puncture device creates the auxiliary opening by forming a hole or rupture along a lower portion of the sidewall.

The beverage may be consumed rapidly though the auxiliary opening, as discussed above. Additionally, the auxiliary opening may be used to introduce another beverage to be consumed with the original contents. As described in more detail below, after being punctured, the can may be turned within the puncture device in order to expel at least some fluid. After removing some of the original contents, a fluid such as an alcoholic beverage (or other type of beverage) may be introduced into the can through the auxiliary opening. One or more patrons may remove a punctured can from the puncture device and consume the contents using the auxiliary opening. In some cases, a patron may create a top opening in the can by actuating or popping the tab or other opening feature. As discussed above, this may create a vent that causes the contents of the can to expel rapidly from the auxiliary opening.

To facilitate the foregoing, the puncture device may include a base and a pivot arm that can be actuated to puncture an array of beverage cans at substantially the same time. The base may be configured to hold an array of beverage cans. For example, the base may include various locating features, supports, guides, or the like, that orient the cans for puncturing by a pivoting movement of the arm. In some implementations, the base may be used to position the cans along a row and spaced apart from one another. The base may also be configured to hold the cans in an elevated or tilted orientation, which may help to retain the beverage in the cans when punctured.

The arm may be configured to advance an array of puncture teeth toward the array of beverage cans held by the base and press the puncture teeth into the cans to puncture a sidewall of each of the respective cans. The arm may be pivotally coupled to the base, thereby allowing the arm to be rotated (e.g., manually) relative to the base and advance toward the array of beverage cans. Rotating the arm relative to the base may drive each puncture tooth of the array of puncture teeth into a respective beverage can to produce an auxiliary opening. In some cases, the arm may include a frame that is pivotally coupled to the base, thereby allowing the arm to rotate relative to the base and advance toward the group of cans. The frame may extend between (and pivot at) opposing sides of the base, and thus extend substantially over each of the array of beverage cans held thereon; however, this is not required. The array of puncture teeth may extend from the frame and include a tip portion that punctures a sidewall of the cans. The array of puncture teeth may include or be spikes, metal punches, spears, and/or other elongated members having a tip portion, pointed feature or the like that is configured to initiate an auxiliary opening when pressed against the can. The puncture teeth may also include a tapered or otherwise contoured portion that may help bend a sidewall into the can as the puncture teeth are advanced into the can.

The array of puncture teeth may be arranged on the frame in order to correspond to a position of each can of the array of beverage cans held by the base. For example, each puncture tooth of the array of puncture teeth may be positioned above a respective beverage can of the array of beverage cans. As such, each of the array of puncture teeth may puncture a respective one of the array of beverage cans when the arm is rotated relative to the base and advanced toward the cans. In other embodiments, however, the puncture teeth may be arranged in order to create multiple auxiliary openings in a single can. Where a single auxiliary opening is formed, the frame may pivot relative to the base in order to allow each of the array of puncture teeth to advance into, and puncture, a sidewall of a corresponding can. For example, the base may hold or support opposing ends of the can and the puncture tooth may be advanced into the can near an inclined portion of the can (typically near the bottom end of the can). This may form an auxiliary opening in the can that ruptures an internal sealed environment. A pivoting dimension of the frame may be such that the auxiliary opening is formed near (but offset from) one of the opposing ends of the can, such as near a bottom end of the can. In some cases, the auxiliary opening is formed within 40 mm from the bottom end of the can. In some cases, the auxiliary opening is formed between 5 mm and 20 mm from the bottom end of the can. This may allow the arm to form an auxiliary opening through a portion of the can without significantly buckling or deforming the can in a region that surrounds the auxiliary opening.

In some implementations, the base is configured to position, hold, or otherwise orient an array of beverage cans in an inclined or tilted orientation. In particular, the base may be configured to orient the beverage can such that one end of the beverage can is inclined with respect to the other. In some cases, a bottom end of the can is inclined with respect to a top end. In some cases the top end of the can is positioned lower than the bottom end of the beverage can. As described herein, a puncture may be formed in the sidewall of the can near the bottom end of the can. Because the cans are positioned in a tilted or inclined orientation, the beverage contents of the can may remain in the can without spilling.

In some implementations, the fluid or the beverage held within the array of beverage cans may be expelled or removed after the sidewall has been punctured by the (single) pivot arm. This may be desirable in order to remove a portion of fluid held within a can, for example, in order to fill the beverage can with an alcoholic beverage (e.g., spirits, whiskey, liqueur) or other beverage through the auxiliary opening. In this regard, it may be beneficial that the base allow each can to rotate along a longitudinal axis to allow some of the contents to remove, spill, or otherwise expel some of the beverage from the can. The expelled fluid may accumulate or collect within the base. In some implementations, the expelled fluid may be gathered or contained in a catch tray positioned below the array of beverage cans. As such, the base may include at least one side surface having, or coupled with, an outlet that defines a flow path between the catch tray and an external environment. This may allow fluid collected within the base to exit the puncture device and flow to a drain (via a hose) or other disposal mechanism.

The puncture device may include other features that may facilitate use of the device in an hospitality or commercial environment. For example, as described in more detail herein, the puncture device may include a bracket, fixture, or other securement features that may secure the device to a bar, counter, or table top. In some cases, the securement features include an eyelet that may be used to lock the device to the bar, counter, or table top using a padlock, cable, or other security device. As described herein, a bracket or plate may be used in conjunction with the eyelet to constrain movement of the puncture device along multiple directions.

In some embodiments, the puncture device may be adaptable to receive a variety of beverage cans having different sizes. For example, the base may include locating or receiving features that are configured to hold cans of various widths within the base. Additionally or alternatively, cans of various lengths may be accommodated by altering a position at which the arm pivots relative to the base. For example, the base may define multiple positions at which the arm may pivot, and the arm may be configured to transition between the multiple positions. In turn, this may alter a path of travel of the array of puncture teeth relative to an array of beverage cans when the arm is rotated. Thus, the device may be adjusted so that the auxiliary openings may be formed near, for example, a bottom end of a can for a variety of different length cans. Or, conversely, the altered path of travel of the array of puncture teeth may allow the auxiliary opening to be formed at various locations for a can of a given length. It will be appreciated that the base may employ various structures to accommodate cans of various sizes, including various pins, openings, bearings, washers, seats, levers, handles, and so on, which are contemplated within the scope of the present disclosure.

Reference will now be made to the accompanying drawings, which assist in illustrating various features of the present disclosure. The following description is presented for purposes of illustration and description. Furthermore, the description is not intended to limit the inventive aspects to the forms disclosed herein. Consequently, variations and modifications commensurate with the following teachings, and skill and knowledge of the relevant art, are within the scope of the present inventive aspects.

FIG. 1 depicts an example puncture device 100. The puncture device 100 may be configured to puncture an array of beverage cans at substantially the same time when the puncture device 100 is actuated. For example, a pivot arm 150 may be advanced toward an array of beverage cans held within the puncture device 100. As the pivot arm 150 contacts each of the cans, an array of features (e.g., puncture teeth 164*a*-164*d*) may form an auxiliary opening in a sidewall of each of the array of beverage cans.

As shown in FIG. 1, the puncture device 100 may include a base 110. The base 110 may be configured to hold or position each of an array of beverage cans. In the present embodiment, the base 110 is configured to position each of the cans in an inclined or tilted orientation. The puncture device 100 may further include an arm 150 that is pivotally coupled to the base 110. For example, the arm 150 may be connected to opposing sides of the base 110 and allowed to rotate about a pin or other feature connected to the arm 150 and the base 110. This may allow the arm 150 to rotate relative to the base 110 and toward an array of beverage cans held thereon. As described below, the arm 150 may include teeth, spikes, metal punches, or the like, thereby allowing the arm 150 to puncture a sidewall of each of an array of beverage cans held by the base 110 when rotated.

In one embodiment, the base 110 may have four sidewalls that define a cavity. The array of beverage cans may be held by the base 110 and at least partially within the cavity. One or more of the four sides may include features used to support, position, and/or otherwise arrange the cans. The four sides may also include other features that facilitate a pivotal coupling of the arm 150 and the base 110, securement of the base 110 to an external structure, and so on, as described herein. In other embodiments, however, other shapes and configurations are possible. In this example, the base 110 is shown in FIG. 1 having a first sidewall 112*a*, a second sidewall 112*b*, a third sidewall 112*c*, and a fourth sidewall 112*d*. The first sidewall 112*a* and the second sidewall 112*b* may define opposing sides of the base 110; and, correspondingly, the third sidewall 112*c* and the fourth sidewall 112*d* may also define opposing sides of the base 110. The third sidewall 112*c* and the fourth sidewall 112*d* may extend between the first sidewall 112*a* and the second sidewall 112*b* in order to define a cavity 114. The cavity 114 may be an open cavity that receives some or all of an array of beverage cans held by the base 110. For example, the cavity 114 may be bounded by a bottom 113 of the base 110 and substantially unobstructed at a top region, thereby allow the cavity 114 to at least partially receive an array of beverage cans. In some cases, the base defines or includes a capture tray that forms a bottom surface of the cavity 114. In some embodiments, however, a cover, case, shield, or the like may be positioned over the cavity 114, for example, which may help at least partially conceal the array of beverage cans and/or contain fluid expelled from the cans when punctured.

Each of the array of beverage cans may be held within the base 110 and extend between the first sidewall 112*a* and the second sidewall 112*b*. The first sidewall 112*a* and the second sidewall 112*b* may include structures, openings, and/or other features that may support opposing ends of each of the array of beverage cans. For example, the first sidewall 112*a* may include front locating features 122 and the second sidewall 112*b* may include rear locating features 124. The front locating features 122 may be configured to support and position a top end of a can within the base 110, whereas the rear locating features 124 may be configured to support and position a bottom end of a can within the base 110. In this regard, the front locating features 122 and the rear locating features 124 may cooperate to receive opposing ends of cans held within the base 110. As shown in FIG. 1, the front locating features 122 may be openings in the first sidewall 112*a* that may receive a top end of a can. The rear locating features 124 may be scalloped features or openings formed in the second sidewall 112*b* that may form a seat or other structure that constrains a position of the can within the base 110. It will be appreciated, however, that the front locating features 122 and the rear locating features 124 are not limited to the geometry depicted with respect to FIG. 1. Rather, the front locating features 122 and the rear locating features 124 may be substantially any structure configured to support and position cans within the base 110, including, rods, plates, magnets, clips, contoured and/or textured surfaces, and so on.

The base 110 may be configured to hold or position each of the array of beverage cans in a tilted or inclined orientation between the first sidewall 112*a* and the second sidewall 112*b*. For example, in the embodiment of FIG. 1, the front locating features 122 may be at a position on the first sidewall 112*a* that is closer to the bottom 113 than a position of the rear locating features 124 on the second sidewall 112*b*. In particular, the front locating features 122 may be at a position on the first sidewall 112*a* that is separated from the bottom 113 by a distance 123 and the rear locating features 124 may be at a position on the second sidewall 112*b* that is separated from the bottom 113 by a distance 125. The distance 123 may be less than the distance 125. As such, cans supported within the base 110 by the front locating features 122 and the rear locating features 124 may be positioned in an inclined orientation (e.g., tilted or positioned at an angle) relative to the bottom 113. The bottom 113 may be positioned along or fixed to a bar top or other substantially flat surface. Accordingly, the array of beverage cans may be held within the base 110 at an incline or tilt relative to a bar top. As described herein, this may facilitate puncturing a sidewall of a can near one of the opposing ends and retaining the beverage in the can due to the incline or tilt. As explained in some embodiments, the base 110 may also allow each can to rotate to expel fluid from the can, and filling the can with another beverage before removing from the puncture device 100.

As described above, the arm 150 may be pivotally coupled to the base 110. The arm 150 may be pivotally coupled to the third sidewall 112*c* and the fourth sidewall 112*d* and extend substantially over the array of beverage cans held within the cavity 114. Broadly, the arm 150 may move between an "open" configuration (shown in FIG. 1) and a "puncture" configuration (e.g., as depicted with respect to FIGS. 2B and 4B). In the open configuration, the arm 150 may be positioned above the cavity 114 in a manner that allows cans to be received within the cavity 114 (and/or supported by the front locating features 122 and rear locating features 124) substantially unobstructed. In the puncture configuration, the arm 150 (e.g., teeth, punch, spikes, or the like) extend at least partially into the cavity 114 and thus puncture a sidewall of cans held therein.

To facilitate the foregoing, the arm 150 may include various structures that allow it to rotate relative to the base 110 and puncture an array of beverage cans at substantially the same time or with a single actuation of the arm 150. For example, as shown in FIG. 1, the arm 150 may include a frame 154. The arm 150 may be a yoke (e.g., a u-shaped member or bracket) that is pivotally attached to the third sidewall 112*c* of the base 110 at one end and the fourth sidewall 112*d* of the base 110 at another end. The arm 150 may be a substantially rigid member. As such, force applied to one portion of the arm 150 may cause the frame 154 to rotate relative to the base 110 (e.g., at the pivotal coupling at the third sidewall 112*c* and the fourth sidewall 112*d*).

The arm 150 may include a handle 158 to help facilitate movement of the arm 150. The handle 158 may be attached to the frame 154 and configured to be grasped by a user. For example, the handle 158 may be a cylindrical or other elongated member extending from the frame 154. A user may manipulate the handle 158 in order to rotate the frame 154 relative to the base 110. While the handle 158 is shown in FIG. 1 as extending from the frame 154 at a middle portion, it will be appreciated that the handle 158 may be attached to the frame 154 at substantially any position along the frame 154 in order to facilitate rotation of the arm 150 relative to the base 110. Further, the handle 158 and the frame 154 may be attached using a variety of techniques, including embodiments in which the handle 158 and the frame 154 are removably attached, integrally formed, and so on. Additionally or alternatively, the handle 158 may be one of a pair or set of handles that extend from the frame 154. This may be desirable, for example, where the arm 150 is rotated relative to the base 110 from the force of two hands, including from multiple different users.

The arm 150 may be configured to puncture the array of beverage cans using an array of puncture teeth 162. The array of puncture teeth 162 may be a collection of elongated or cantilevered structures that extend from the frame 154. For example, each "puncture tooth" of the array of puncture teeth may be a spike, metal punch, spear, or the like having a fixed end attached to the frame 154 and a second, free end opposite the fixed end and extending from the frame 154. The free end of an individual puncture tooth may define a tapered portion and a tip portion that extends from the tapered portion. The tip portion may be configured to pierce or initiate a puncture or rupture a sidewall. As the puncture tooth is advanced inward toward the can, the tapered portion may be an angled, convex, concave, or otherwise contoured surface that is configured to locally deform the sidewall to create the opening. In some implementations, the tapered portion bends and/or tears a portion of the sidewall of the can subsequent to being punctured by the puncture tooth. This may help create or widen the opening created by the tip portion. The size and shape of the tapered portion may be configured to provide a particular sized opening that both allows other beverages to be introduced into the can and also forms a suitable opening for consuming the contents. In some implementations, the opening is between 5 mm and 30 mm in diameter. It will be appreciated, however, that the puncture tooth may be constructed to define various geometries to facilitate the foregoing; sample alternative embodiments of teeth for the puncture device 100 are described with respect to FIGS. 5A-5C below.

In the embodiment of FIG. 1, the array of puncture teeth 162 may include four individual teeth. For example, the array of puncture teeth 162 may include a first puncture tooth 164*a*, a second puncture tooth 164*b*, a third puncture tooth 164*c*, and a fourth puncture tooth 164*d*. Each of the array of puncture teeth 162 may be positioned on the frame 154 corresponding to a position of a can of the array of beverage cans held within the base 110. Accordingly, when the arm 150 is advanced toward the array of beverage cans, each of the array of puncture teeth 162 may puncture a sidewall and extend into a separate, respective can. In some embodiments, as shown in FIG. 1, each of the array of puncture teeth 162 may be aligned with corresponding pairs of front locating features 122 and rear locating features 124. For example, each of the first puncture tooth 164*a*, the second puncture tooth 164*b*, the third puncture tooth 164*c*, and the fourth puncture tooth 164*d* may be substantially aligned with corresponding pairs of the front locating features 122 and the rear locating features 124. As such, when the arm 150 is pivoted relative to the base 110 and into the puncture configuration (FIGS. 2B and 4B), each of the first puncture tooth 164*a*, the second puncture tooth 164*b*, the third puncture tooth 164*c*, and the fourth puncture tooth 164*d* may extend between the corresponding pairs of the front locating features 122 and the rear locating features 124, thereby puncturing a sidewall of cans held therebetween.

The arm 150 and array of puncture teeth 162 may be configured to puncture the sidewall of each can in a region that is located near the bottom end of each respective can. In some implementations, each puncture tooth 164*a-d* is configured to pierce the sidewall of the can in a location that ranges between 10 mm and 20 mm from the bottom end of the can. In some implementations, each puncture tooth 164*a-d* is configured to pierce the sidewall in a location that ranges between 5 mm and 30 mm from the bottom of the can. This may avoid unnecessary deformation of the sidewall and prevent the can from collapsing or being flattened when being pierced or punctured.

FIGS. 2A-2E depict various configurations and modes of operation of the puncture device 100 described above with respect to FIG. 1. Broadly, the puncture device 100 may alternate between an "open" configuration and a "puncture" configuration. In the open configuration, the arm 150 may be positioned above the cavity 114 in order to allow beverage cans to be positioned therein substantially unobstructed. In the puncture configuration, the arm 150 may be rotated or pivoted relative to the base 110, for example manually (e.g., without a motor), to drive each puncture tooth 164*a-d* of the array of puncture teeth 162 into a respective beverage can 170 of an array of beverage cans held by the base 110 within the cavity 114 to produce an auxiliary opening in each beverage can. The arm 150 may be subsequently rotated from the puncture configuration and back into the open configuration in order to allow a patron to remove a punctured can from the puncture device 100.

Figure 2A:
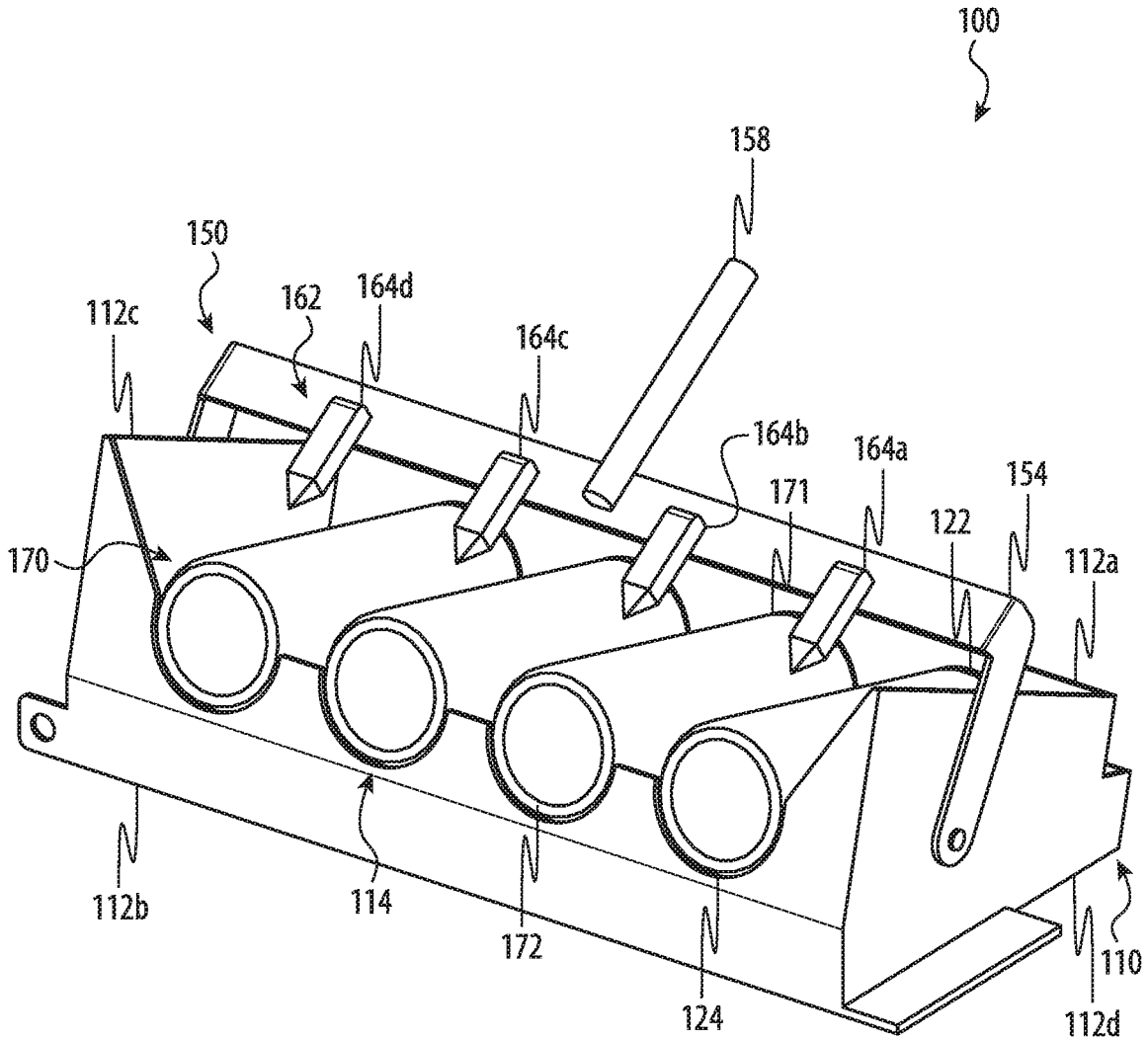
FIG. 2A depicts the puncture device of FIG. 1 in an open configuration and with an array of beverage cans.

With reference to FIG. 2A, the puncture device 100 is shown in the open configuration. In the open configuration, the arm 150 is rotated to a position above the cavity 114. The puncture device 100 is shown holding an array of beverage cans 170. Each of the array of beverage cans 170 may have a top end 171 and a bottom end 172. The top end 171 generally corresponds to the end of the can having the tab or opening that is configured for normal beverage consumption. The bottom end 172 is opposite to the top end 171 and is generally free of openings or tabs. The top end 171 and the bottom end 172 (of each of the array of beverage cans 170) may be received or otherwise supported within the base 110 by corresponding pairs of the front locating features 122 and rear locating features 124. As shown in FIG. 2A, each can is positioned in a tilted or inclined orientation in which the top end 171 is positioned lower than the bottom end 172 of the beverage can. Stated another way, the bottom end 172 may be positioned further away from the bottom 113 of the base 110 than the top end 171 to define the tilted or inclined orientation. As shown in FIG. 2A, each puncture tooth 164*a-d* of the array of puncture teeth 162 may be positioned above a respective beverage can 170 of an array of beverage cans positioned in the base 110.

Figure 2B:
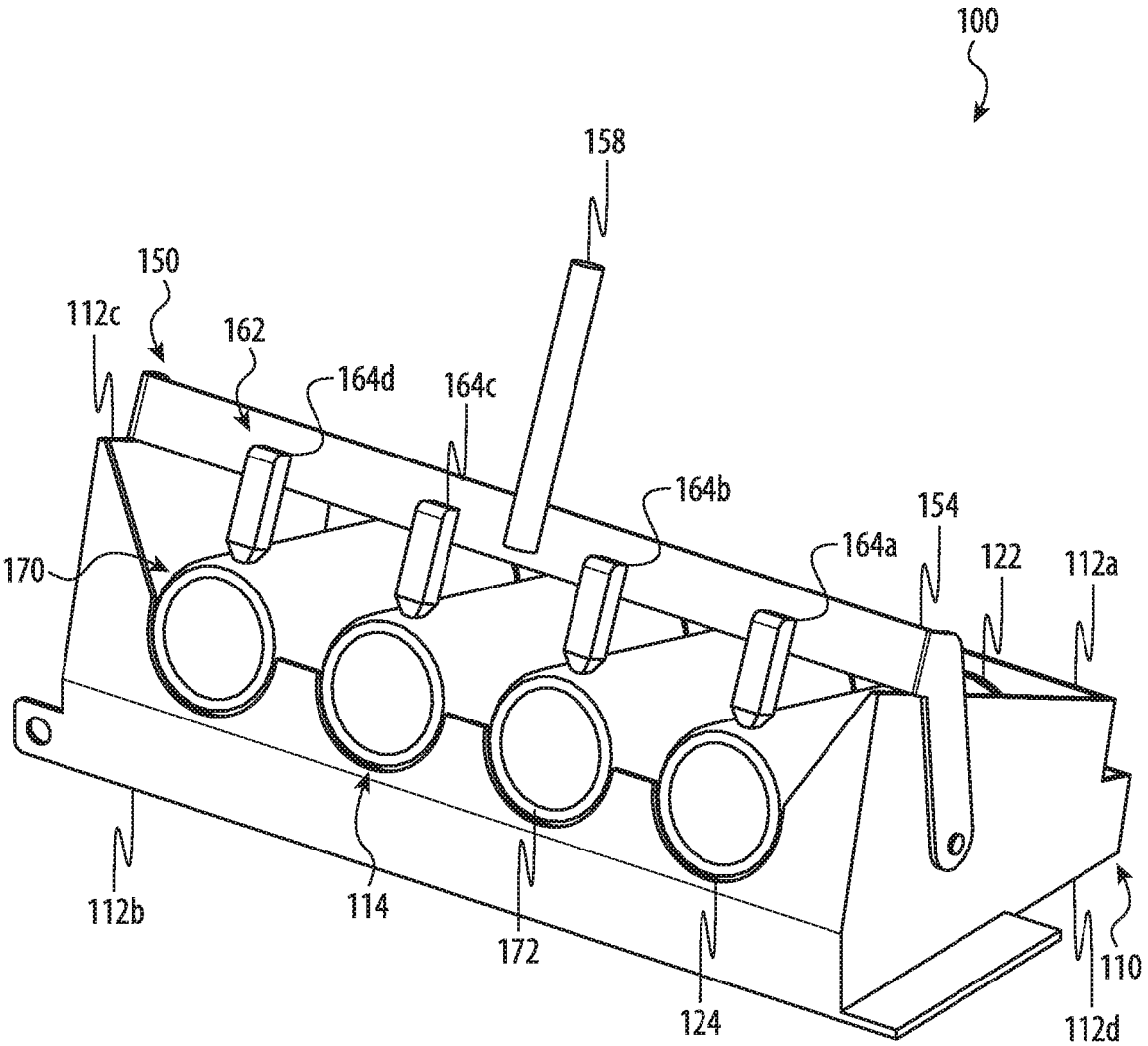
FIG. 2B depicts the puncture device having an array of puncture teeth that extend into the array of beverage cans to define a puncture configuration.

With reference to FIG. 2B, the puncture device 100 is shown in the puncture configuration. In the puncture configuration, the arm 150 is rotated to a position that at least partially extends into the cavity 114. For example, the array of puncture teeth 162 may extend at least partially into the cavity 114 when the puncture device 100 is in the puncture configuration. In the embodiment of FIG. 2B, the array of beverage cans 170 are positioned at least partially within the cavity 114. Accordingly, during a transition from an open configuration, such as shown in FIG. 2A, to a puncture configuration, such as shown in FIG. 2B, the arm 150 is rotated relative to the base 110 and drives each puncture tooth of the array of puncture teeth 162 into a respective beverage can 170 of the array of beverage cans of the array of beverage cans 170 to produce an auxiliary opening in each can. In some cases, the arm 150 may be rotated manually. The puncture device 100 may be designed such that a motor or other device is not necessary to produce the auxiliary openings. As described in greater detail below with respect to FIGS. 4A and 4B, the array of puncture teeth 162 may puncture or rupture the array of beverage cans 170 near one of the opposing ends of the cans, such as near bottom end 172.

Figure 2C:
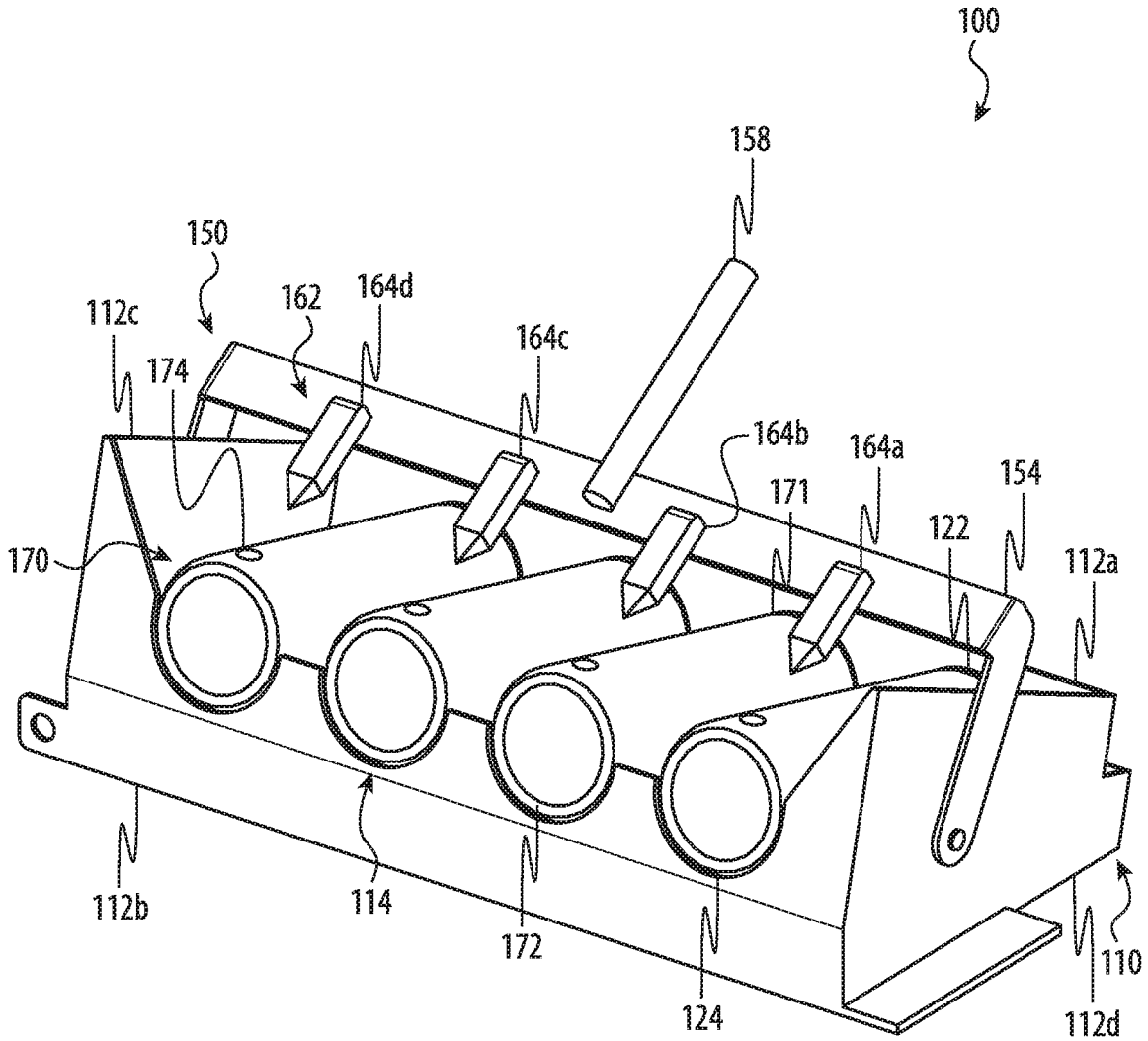
FIG. 2C depicts the puncture device in the open configuration and having an array of punctured cans.

With reference to FIG. 2C, the puncture device 100 is shown rotated from the puncture configuration and back into the open configuration, such as the open configuration described above with respect to FIG. 2A. In the embodiment of FIG. 2C, each of the array of beverage cans 170 may have an auxiliary opening 174 formed in a sidewall of each can. The auxiliary opening 174 may be formed into a sidewall of each beverage can of the array of beverage cans 170 as the puncture device 100 transitions to the puncture configuration, for example, as described above with respect to FIG. 2B. The auxiliary opening 174 may have a width corresponding to a width of one of the array of puncture teeth 162 and be positioned near the bottom end 172 of a given one of the array of beverage cans 170. In some implementations, each puncture tooth 164*a-d* is configured to pierce the sidewall of the can in a location that ranges between 10 mm and 20 mm from the bottom end of the can. In some implementations, each puncture tooth 164*a-d* is configured to pierce the sidewall in a location that ranges between 5 mm and 30 mm from the bottom end of the can. In some cases, each auxiliary opening has a width (e.g., a diameter or another distance across the opening) between 5 mm and 30 mm. In some cases the opening has a width of at least 5 mm to facilitate drinking of the contents of the beverage can without opening a top opening of the can. As discussed previously, this may avoid unnecessary deformation of the sidewall and prevent the can from collapsing or being flattened when being pierced or punctured.

Figure 2D:
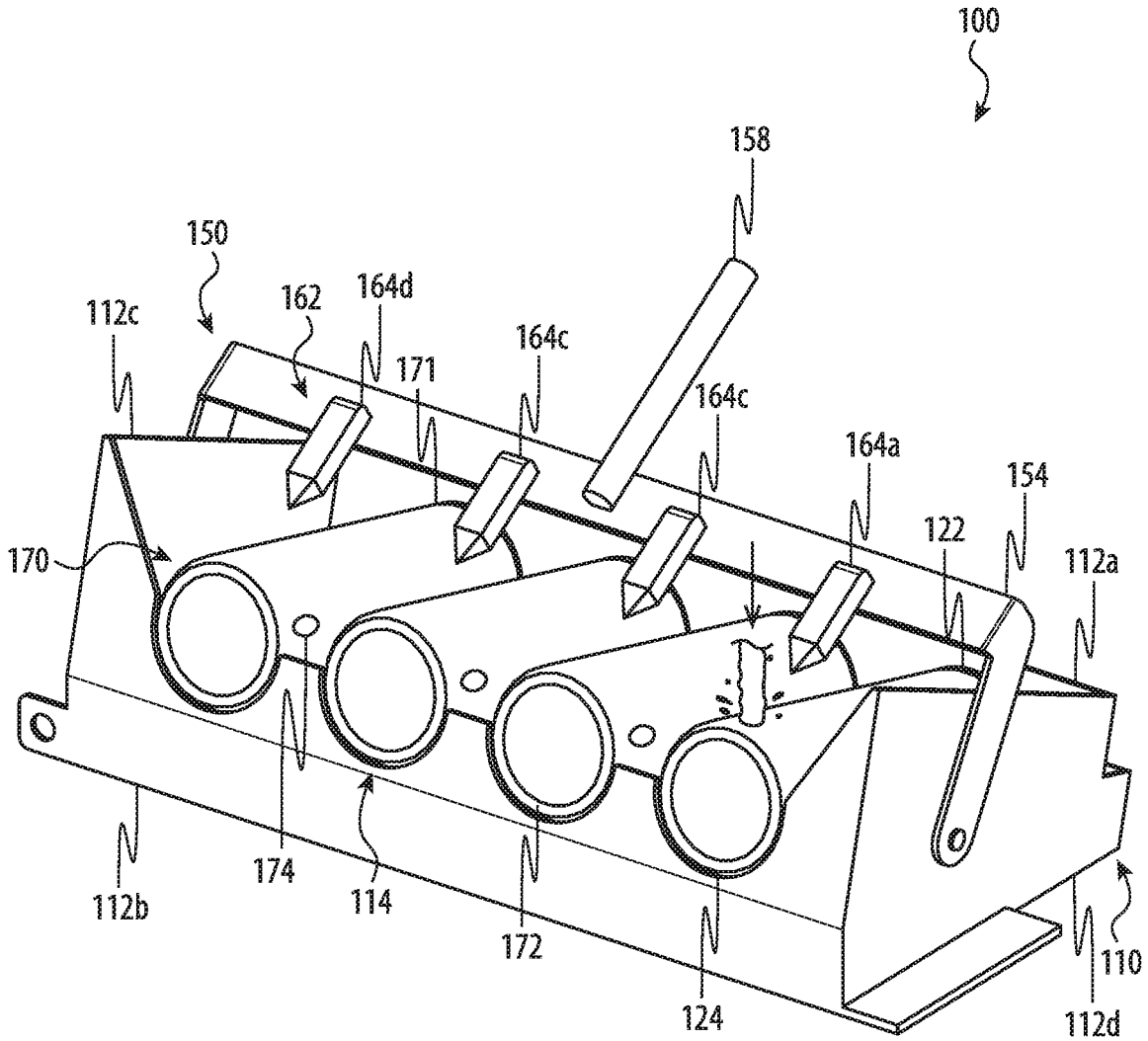
FIG. 2D depicts the array of beverage cans rotated within the puncture device.

With reference to FIG. 2D, at least some of the array of beverage cans 170 are shown turned within the base 110 of the puncture device 100. For example, the auxiliary opening 174 of each of the array of beverage cans 170 may be rotated or turned from a position of the auxiliary opening shown in FIG. 2C (e.g., a position resulting from the single pivoting movement of the arm 150 toward the array of beverage cans 170). This rotation may be described as a rotation about the longitudinal axis of a can of the array of beverage cans 170.

In some implementations, some amount of fluid may be expelled or drained from a can at the auxiliary opening 174 when formed in the operation of the puncture device 100 in the puncture configuration. When turned or rotated, further fluid may exit the can through the auxiliary opening 174. This may allow the can to be subsequently turned in order to receive another second beverage, as shown in FIG. 2D, through the auxiliary opening 174. The second or additional beverage may be an alcoholic beverage, such as spirits, whiskey, liqueur, and so on. In some cases, the second or additional beverage may be a non-alcoholic beverage or mixer. However, it will be appreciated that adding another beverage to the can is not required. In some cases, a punctured can may be removed (and consumed) from the puncture device 100 without adding another beverage.

Figure 2E:
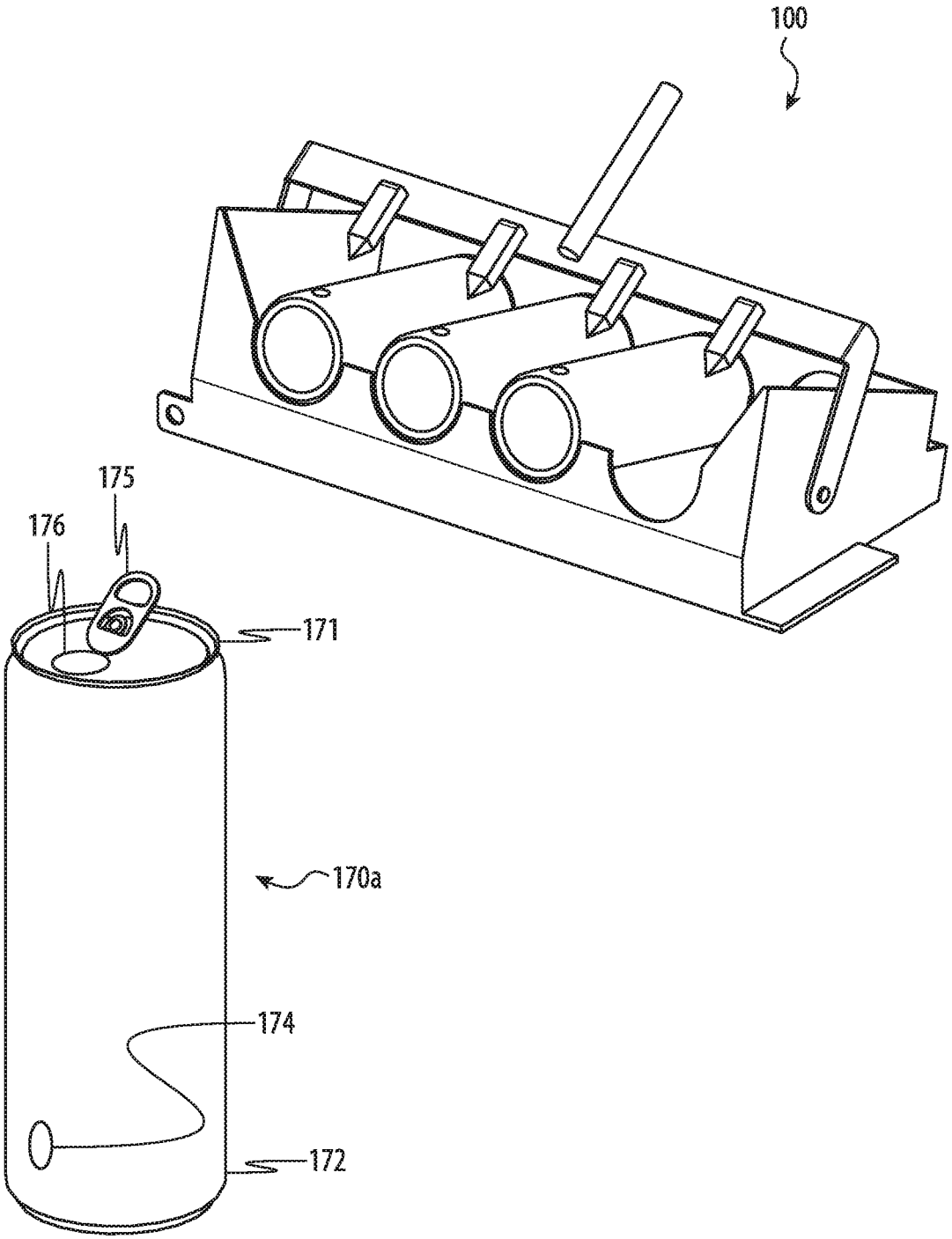
FIG. 2E depicts a can of the array of beverage cans removed from the puncture device and having a top opening and an auxiliary opening.

With reference to FIG. 2E, a can 170*a* of the array of beverage cans 170 is shown removed from the puncture device 100. The can 170*a* may have the auxiliary opening 174 positioned near the bottom end 172. The can 170*a* may have a tab 175 or other opening feature positioned at the top end 171. The tab 175 may be actuated in order to form a top opening 176 at the top end 171. The formation of the top opening 176 may create or define a vent in the can 170*a* that may allow fluid contained therein to be expelled from the auxiliary opening 174 at a rate that is increased with respect to an unvented can 170*a*. In some cases, the fluid of other contents of the can 170*a* may be consumed from the flow expelled at the auxiliary opening 174. As discussed above, in some cases the opening has a width of at least 5 mm to facilitate drinking of the contents of the beverage can without opening a top opening of the can.

Figure 3:
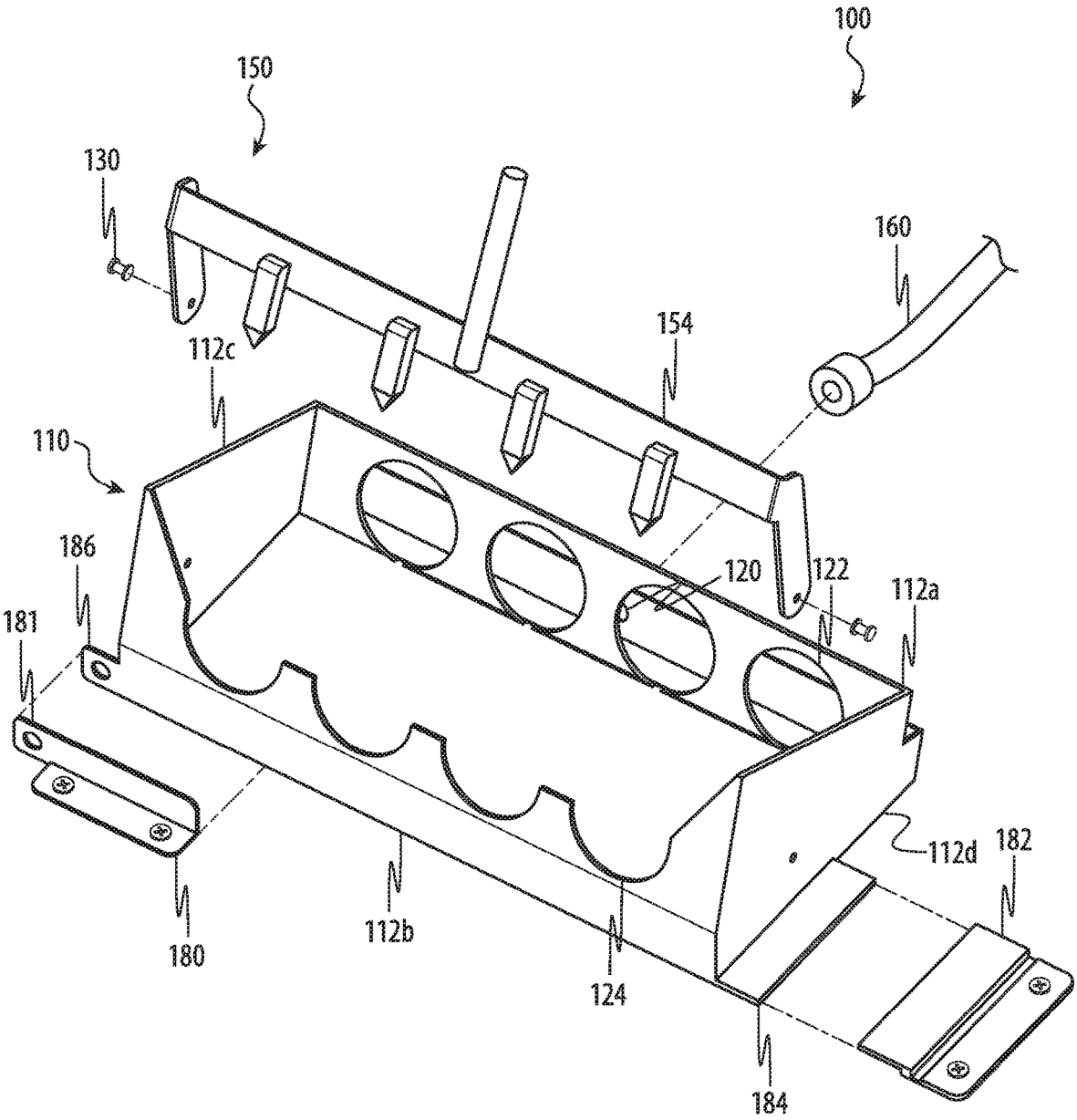
FIG. 3 depicts an exploded view of the puncture device of FIG. 1.

FIG. 3 depicts an exploded view of the puncture device 100. As described herein, the puncture device 100 includes the base 110 and the arm 150. The puncture device 100 is shown in FIG. 3 without the array of beverage cans 170 described above with respect to FIGS. 2A-2E. As described herein, the front locating features 122 may be configured to receive the top end 171 of each of the array of beverage cans 170. And, correspondingly, the rear locating features 124 may be configured to receive the bottom end 172 of each of the array of beverage cans 170.

In order to facilitate rotation of the arm 150 relative to the base 110, the puncture device 100 may include a pin 130 or other component that may be used to pivotally couple the arm 150 and the base 110. The pin 130 may, for example, be a rod or shaft that extends through an opening in the frame 154 and the base 110. Multiple pins may be used in order to pivotally couple the frame 154 to the base 110 at multiple points, such as at the third sidewall 112*c* and the fourth sidewall 112*d*; however, in other cases, a single pin may extend between the third sidewall 112*c* and the fourth sidewall 112*d* to facilitate such coupling. The pin 130 may be secured to the frame 154 and the base 110 in a manner that allows for relative movement between each component. This may be accomplished by various structures, including a plate or pin head, washers, nuts, other pins, and so forth. While the present embodiment is described with respect to a single pivot point, other mechanisms may be used that may include multiple pivot points. For example, a multiple pivot linkage (e.g., a four-bar linkage) may be used instead of the single pivot configuration described in some examples.

As described herein, fluid from the array of beverage cans 170 may be expelled into the cavity 114 or a catch tray during operation of the puncture device 100. This may occur, for example, when the array of beverage cans 170 are punctured by the array of puncture teeth 162 (in the puncture configuration), when punctured cans are turned, and/or from a patron removing the punctured can from the base 110, among other possibilities. The base 110 may include, or be coupled with, an outlet 120. The outlet 120 may be an opening in one or more sides of the base 110 (e.g., first sidewall 112*a*, second sidewall 112*b*, third sidewall 112*c*, fourth sidewall 112*d*). As shown in FIG. 3, the outlet 120 may be an opening defined in a lower portion of the base 110 along the first sidewall 112*a*. The outlet 120 may define a flow path between the cavity 114 or a catch tray and an external environment. As such, fluid that accumulates or collects within the cavity 114 may exit the base 110 from the outlet 120. In some cases, the bottom 113 may be partially sloped or pitched in order to direct fluid collected within the cavity 114 toward the outlet 120.

In certain embodiments, the puncture device 100 may include a hose or tube 160. The tube 160 may be substantially any conduit, tubing, or the like that may be coupled with the outlet 120. The tube 160 may direct fluid from the outlet 120 to an external drain or other removal system. This may be beneficial in a hospitality or commercial environment, in which excess fluids from the puncture device 100 are routed to a common drain (e.g., common to multiple fluid dispensing systems arranged along a bar top) after each use of the puncture device 100.

The puncture device 100 may also include various anti-theft or security features. The anti-theft or security features may help secure and/or constrain movement of the puncture device 100 relative to a bar top, counter, table, or other stationary structure. In the embodiment of FIG. 3, the puncture device 100 may include a bracket 180 and a receiving structure 182. The bracket 180 and the receiving structure 182 may be affixed to a bar top or other stationary structure near the base 110. For example, screws or other fasteners may be extended through each of the bracket 180 and the receiving structure 182 and into the stationary structure, which may prevent or mitigate rapid removal.

The base 110 may include various features that may be coupled with, or received by, the bracket 180 and the receiving structure 182. Such features may allow the base 110 to be secured to the stationary structure using the bracket 180 and the receiving structure 182. In the embodiment of FIG. 3, the base 110 may include a plate 184 and an eyelet 186. The plate 184, in an installed configuration, may be slid under and received by the receiving structure 182. This may help orient the base 110 relative to the bracket 180 and constrain movement of the base 110 in two directions. When the plate 184 is received by the receiving structure 182, the eyelet 186 may be substantially aligned with, or positioned near, the bracket 180. The eyelet 186 may be configured to receive a security device (e.g., a padlock, cable, or pin) that constrains movement of the base 110 relative to the bracket 180. For example, the bracket 180 may have a corresponding eyelet 181 that is aligned with the eyelet 186 of the base 110 in the assembled configuration. A padlock (not shown in FIG. 3) may be extended through both of the eyelet 186 and the eyelet 181 in order to secure the puncture device 100 to a stationary structure (e.g., a bar top) that is affixed to the bracket 180 and the receiving structure 182.

Figure 4A:
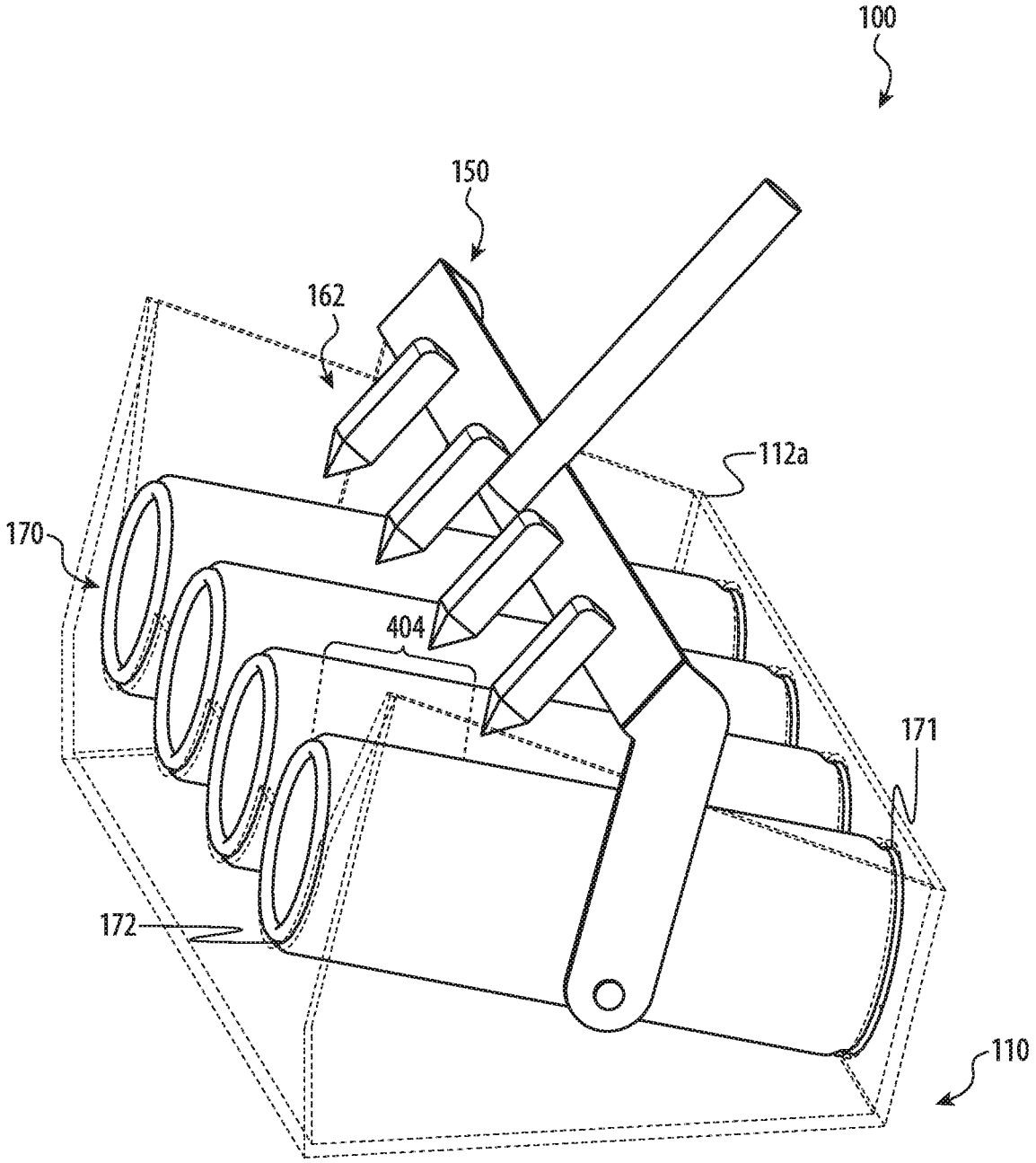
FIG. 4A depicts the puncture device of FIG. 1 having an array of teeth, with each puncture tooth of the array positioned above a respective can of the array of cans.
Figure 4B:
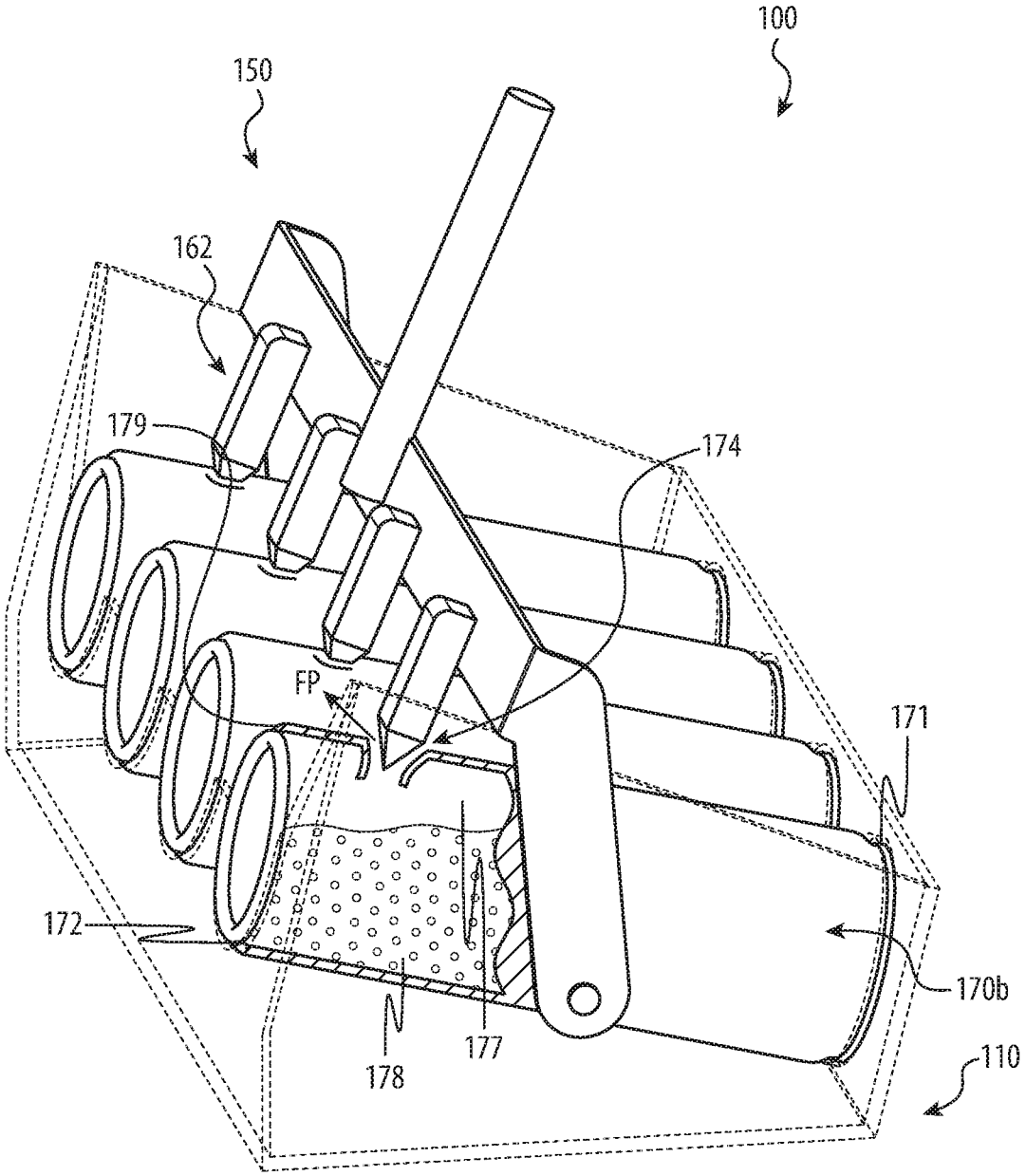
FIG. 4B depicts the array of puncture teeth extending into the array of beverage cans.

FIGS. 4A and 4B depict the puncture device 100 holding the array of beverage cans 170. In particular, FIGS. 4A and 4B show the puncture device 100 undergoing a process for puncturing the array of beverage cans 170. Broadly, and as described in greater detail herein, the array of beverage cans 170 may be received by the puncture device 100. For example, the base 110 may hold the array of beverage cans 170 between opposing sides of the base 110. The arm 150 may receive a force (e.g., from a user or patron) that causes the arm 150 to pivot relative to the base 110 and advance toward the array of beverage cans 170. The arm 150 may continue to advance in order to puncture the array of beverage cans 170 with the array of puncture teeth 162, as described above. The arm 150 may be repositioned above the array of beverage cans 170 in order to allow punctured cans to be removed from the puncture device 100.

With reference to FIG. 4A, the puncture device 100 is shown in a configuration in which the array of puncture teeth 162 is positioned above the array of beverage cans 170. In particular, the puncture device 100 is shown in a configuration prior to forming an auxiliary opening or other hole in the array of beverage cans 170. As shown in FIG. 4A, the arm 150 may be rotated relative to the base 110 and advanced toward the array of beverage cans 170 such that the array of puncture teeth 162 are positioned along sidewalls of the array of beverage cans 170. The arm 150 may be configured to rotate relative to the base 110 such that the array of puncture teeth 162 are positioned along sidewalls of the array of beverage cans 170 at an offset 404 from the bottom end 172. In some implementations, the offset 404 ranges between 10 mm and 20 mm from the bottom end of the can. In some implementations, the offset 404 ranges between 5 mm and 30 mm from the bottom end of the can. This may avoid unnecessary deformation of the sidewall and prevent the can from collapsing, being flattened or otherwise being unnecessarily deformed when being pierced or punctured as the bottom end of the can may provide some structural support for the sidewall. Where the puncture device 100 is configured to receive cans of multiple sizes, the offset 404 may be adjustable.

With reference to FIG. 4B, the puncture device 100 is shown in a configuration in which the array of puncture teeth 162 are advanced, plunged, or pressed into corresponding ones of the array of beverage cans 170 (e.g., between opposing ends of each respective can). This may define a puncture configuration of the puncture device 100, as described herein. When the array of puncture teeth 162 are advanced into the array of beverage cans 170, sidewalls of the cans may rupture, thereby forming an auxiliary opening that defines a flow path between the internal volume of the can and an external environment.

To illustrate the foregoing, FIG. 4B shows a can 170*b* of the array of beverage cans 170 in partial cross-section. The can 170*b* may have a sidewall 179 that forms a barrier between an internal volume 177 of the can 170*b* and an external environment. The sidewall 179 may be a relatively thin portion of the can 170*b*, which may be deformable and pliable when ruptured; however, this not required. The can 170*b* may contain a fluid 178 within the internal volume 177. The fluid 178 may take a variety of forms, including being pressurized, carbonated, non-alcoholic, alcoholic, and so forth. In the embodiment of FIG. 4B, the puncture tooth 164*a* (of the array of puncture teeth 162) may be advanced into the can 170*b* and through the sidewall 179. This may create the auxiliary opening 174, described herein. When the can 170*b* is ruptured by the puncture tooth 164*b*, a flow path FP may be created between the internal volume 177 and an external environment.

As shown in FIG. 4B, the array of beverage cans 170 may be positioned or held in a tilted or inclined orientation within the base 110. As such, the fluid 178 may be held at an angle relative to a bottom portion of the cans. The tilt may be such that the puncture tooth 164*a*, for example, punctures a portion of the sidewall 179 that is adjacent an air pocket or other region of the internal volume 177 that does not contain the fluid 178. This may reduce the amount of the fluid 178 that is expelled from the opening in the sidewall 179 when punctured. In some implementations, the tilt may be an angle that ranges between 5 degrees and 30 degrees as measured from the bottom 113 of the base 110. For example, the tilt may be between 10 degrees and 20 degrees or between 15 degrees and 20 degrees as measured from the bottom 113.

Figure 5A:
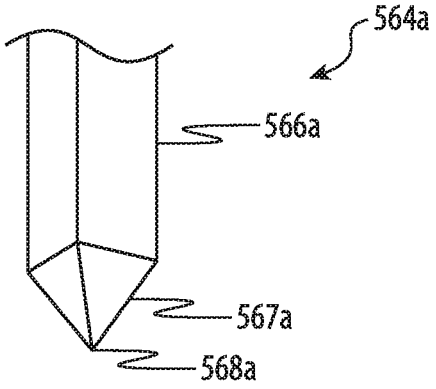
FIG. 5A depicts an example puncture tooth of a puncture device.
Figure 5B:
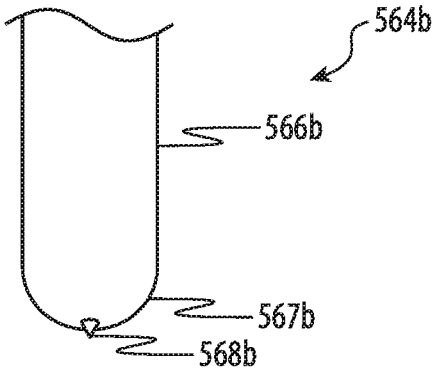
FIG. 5B depicts another embodiment of an example puncture tooth of the puncture device.
Figure 5C:
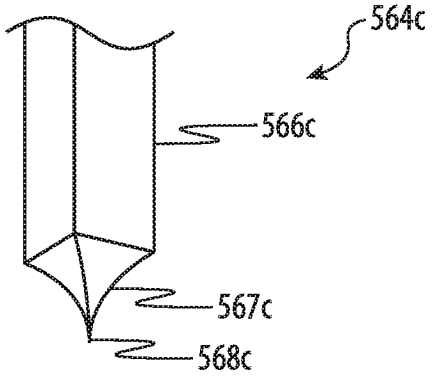
FIG. 5C depicts another embodiment of an example puncture tooth of the puncture device.

FIG. 5A-5C depict sample embodiments of a puncture tooth, such as the any one of the array of puncture teeth 162 described above (e.g., first puncture tooth 164*a*, second puncture tooth 164*b*, third puncture tooth 164*c*, fourth puncture tooth 164*d*). As described herein, teeth of the array of puncture teeth of the present disclosure may be configured to form an auxiliary opening in a can. The puncture teeth may generally be elongated structures that have a tip portion or point at a free end (e.g., for piercing the can). The puncture teeth may also, in some cases, have a tapered or contoured portion that may help bend a sidewall of the can as the puncture tooth is advanced therein. This may help widen the auxiliary opening to an appropriate dimension, such as that which allows the auxiliary opening to receive another beverage and/or be consumed from the auxiliary opening. It will be appreciated that the puncture teeth of the present disclosure may be defined by various different geometries and constructions. In this regard, while FIGS. 5A-5C depict three embodiments of teeth of the present disclosure, other geometries and constructions are contemplated herein.

With reference to FIG. 5A, a puncture tooth 564*a* is shown. The puncture tooth 564*a* may include an elongated portion 566*a*. The elongated portion 566*a* may extend from a frame (e.g., frame 154 of FIG. 1) and have a length that allows the puncture tooth 564*a* to extend at least partially into the a sidewall of a can. The elongated portion 566*a* may be a quadrilateral shape, as shown in FIG. 5A, but other shapes are contemplated herein. The puncture tooth 564*a* may also include a tapered portion 567*a* and tip portion 568*a* that extends from the tapered portion 567*a*. The tip portion 568*a* may be a machined or pointed feature of the puncture tooth 564*a* that is configured to pierce or initiate a puncture of a sidewall of a can. The tapered portion 567*a* may be an angled surface that extends between the tip portion 568*a* and the elongated portion 566*a*. As described herein, the elongated portion 566*a* and/or the tapered portion 567*a* may facilitate bending a sidewall as the puncture tooth is advanced into a can and define the final opening geometry.

With reference to FIG. 5B, a puncture tooth 564*b* is shown. The puncture tooth 564*b* may include an elongated portion 566*b*. The elongated portion 566*b* may extend from a frame (e.g., frame 154 of FIG. 1) and have a length that allows the puncture tooth 564*b* to extend at least partially into the sidewall of a can. The elongated portion 566*b* may be a cylindrical shape, as shown in FIG. 5B, but other shapes are contemplated herein. The puncture tooth 564*b* may also include a tapered portion 567*b* and a tip portion 568*b* that extends from the tapered portion 567*b*. The tip portion 568*b* may be a machined or pointed feature of the puncture tooth 564*b* that is configured to pierce or initiate a puncture of a sidewall of a can. The tapered portion 567*b* may be an angled surface that extends between the tip portion 568*b* and the elongated portion 566*b*. As described herein, the elongated portion 566*b* and/or the tapered portion 567*b* may facilitate bending a sidewall as the puncture tooth 564*b* is advanced into a can and define the final opening geometry.

With reference to FIG. 5C, a puncture tooth 564*c* is shown. The puncture tooth 564*c* may include an elongated portion 566*c*. The elongated portion 566*c* may extend from a frame (e.g., frame 154 of FIG. 1) and have a length that allows the puncture tooth 564*c* to extend at least partially into the sidewall of a can. The elongated portion 566*c* may be a quadrilateral shape, as shown in FIG. 5C, but other shapes are contemplated herein. The puncture tooth 564*c* may also include a tapered portion 567*c* and a tip portion 568*c* that extends from the tapered portion 567*c*. The tip portion 568*c* may be a machined or pointed feature of the puncture tooth 564*c* that is configured to pierce or initiate the puncture of a sidewall of a can. The tapered portion 567*c* may be an angled surface that extends between the tip portion 568*c* and the elongated portion 566*c*. As described herein, the elongated portion 566*c* and/or the tapered portion 567*c* may facilitate bending a sidewall as the puncture tooth is advanced into a can and define the final opening geometry.

FIGS. 6A-6D illustrate an example puncture device 600. The puncture device 600 may be similar to the puncture devices described herein (e.g., puncture device 100) and may include structural features and/or functionality described above with respect to puncture device 100.

The puncture device 600 includes a base 610 having sides that define a cavity 614. One or more cans may be positioned at least partially within the cavity during operation. The puncture device 600 is shown with a capacity for two cans and with one can 670 positioned in the cavity 614. In various embodiments, the puncture device 600 may have a capacity of more or fewer cans, and the number of cans positioned in the puncture device 600 need not be equal to the can capacity.

Figure 6A:
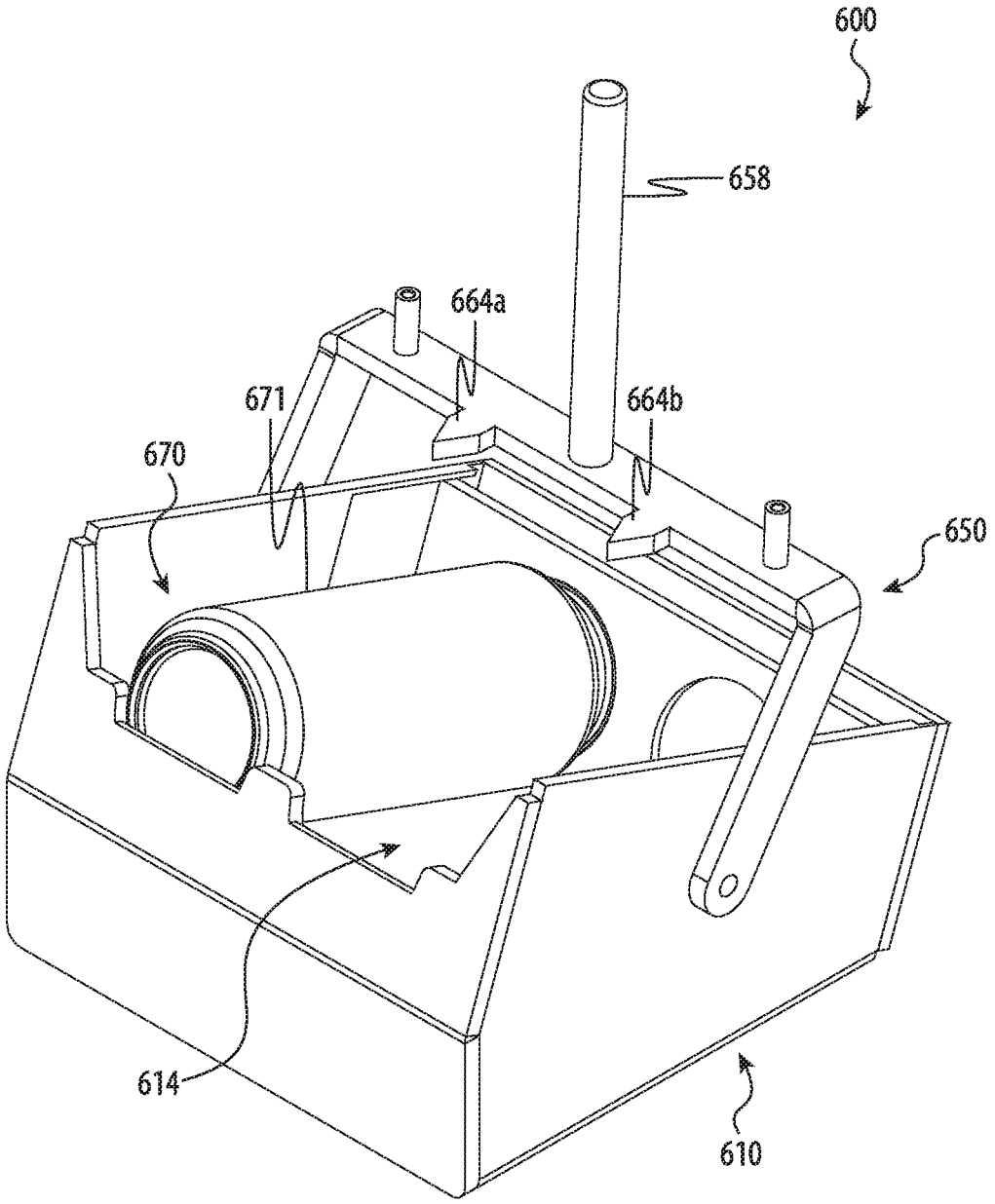
FIGS. 6A-6D depict an example puncture device.
Figure 6B:
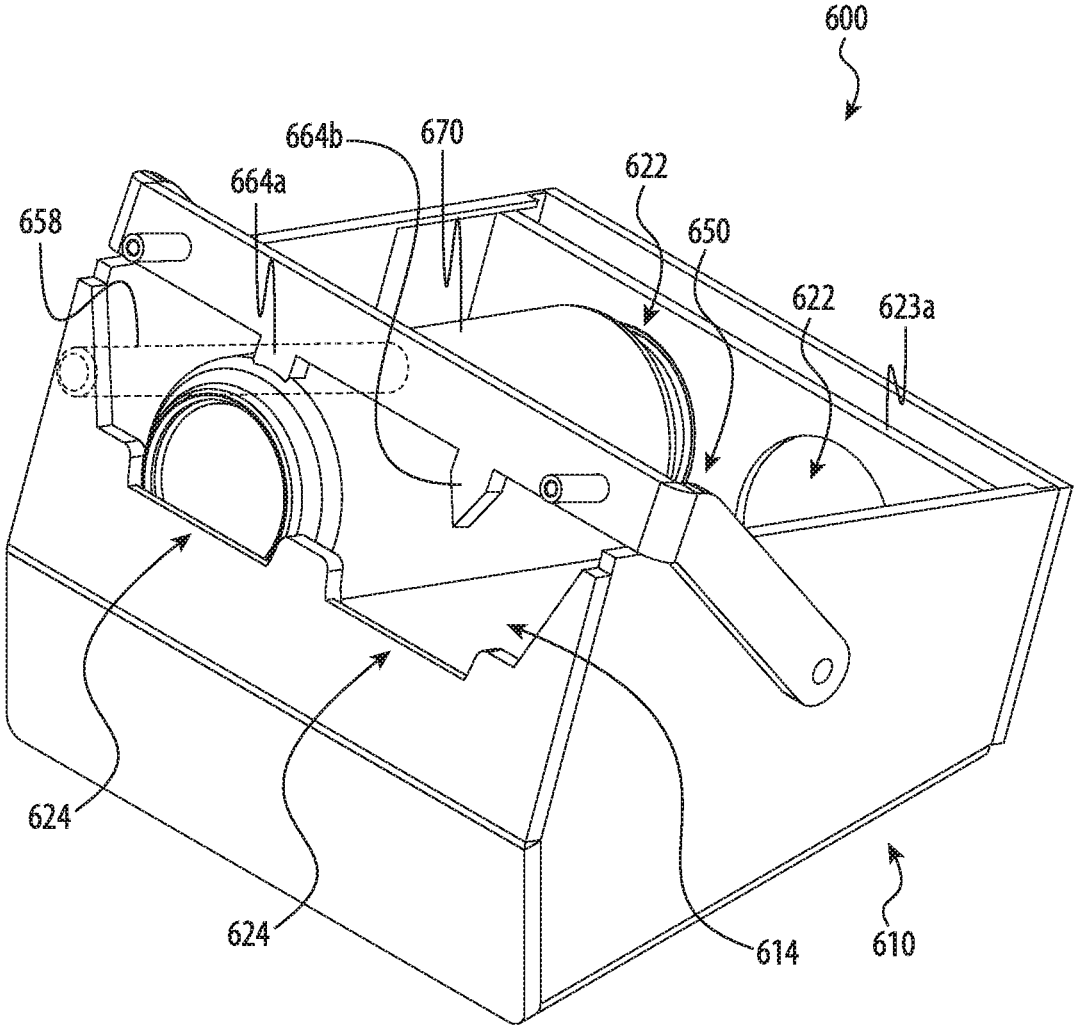

The puncture device 600 may include a pivot arm 650 rotatably coupled to the base 610 and configured to be advance toward one or more cans positioned in the base. The pivot arm 650 may include puncture features (e.g., teeth 664*a* and 664*b*) configured to form an opening in a sidewall of the cans disposed in the base 610 as the pivot arm 650 contacts the cans. For example, as shown in FIG. 6B, as the pivot arm 650 is advanced toward the can 670, the puncture tooth 664*a* may be configured to form an opening in a sidewall 671 of the can 670 as the puncture tooth contacts the can. The pivot arm 650 may include a handle 658 similar to the handle 158 of the puncture device 100 to facilitate movement of the arm by a user.

Similar to the puncture device 100 described above, the puncture device 600 may include one or more locating features for supporting one or more cans in the cavity 614. For example, in some cases, the puncture device 600 includes an array of front locating features 622 and an array of rear locating features 624. The base 610 may be configured to hold the one or more cans at a tilt or incline with respect to a surface on which the base is positioned and/or a bottom surface of the base. As one example, the front locating features 622 may support and position a top end of a can within the base 610, whereas the rear locating features 624 may support and position a bottom end of a can within the base 610. In this regard, the front locating features 622 and the rear locating features 624 may cooperate to receive and support opposing ends of cans held within the base 610.

Figure 6C:
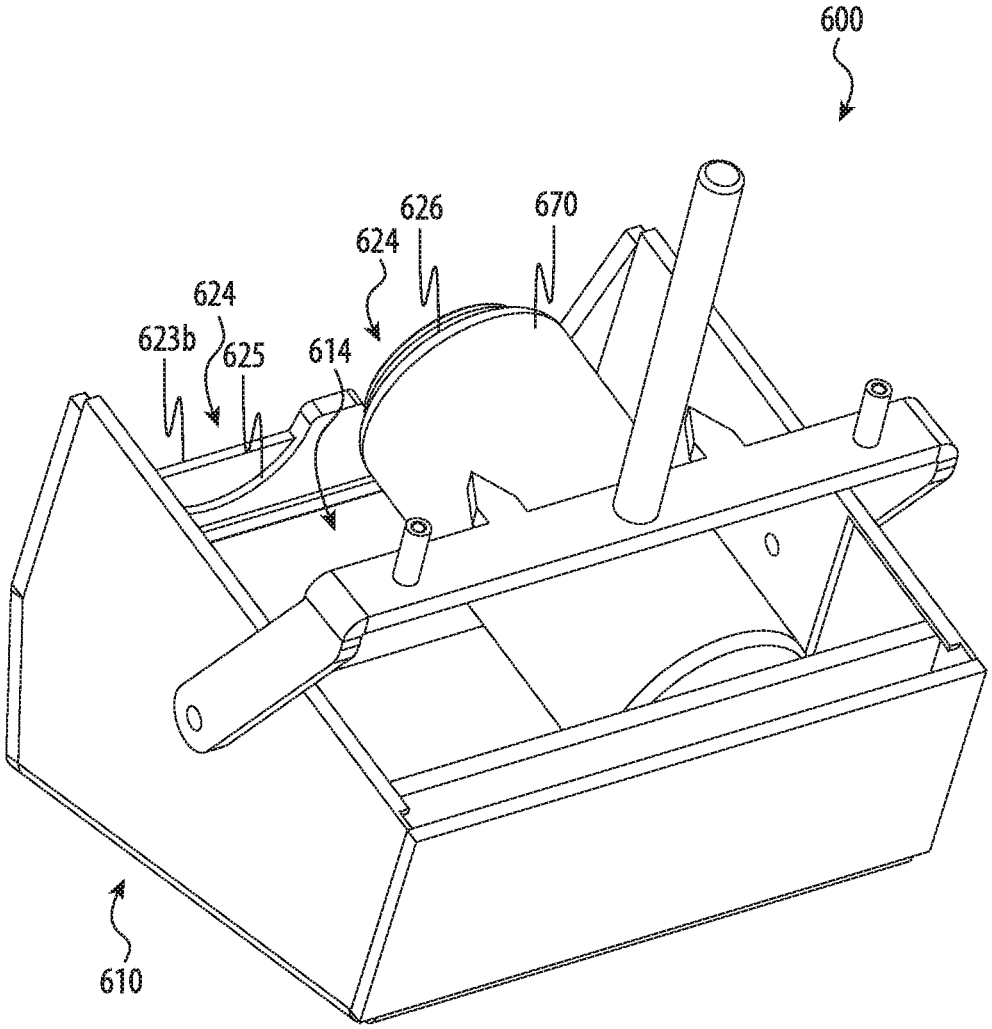

As shown in FIG. 6B, the front locating features 622 may be openings in a first wall 623*a* of the body 610, each of which may receive a top end of a can (or a bottom end of a can). As shown in FIG. 6C, the rear locating features 624 may be scalloped features or openings formed in a second wall 623*b* of the body 610. The rear locating features 624 may include scalloped features that extend only partially through the wall 623*b*, thereby creating a shelf 625 that may support and conform to a shape of a can. In various embodiments, the front locating features and the rear locating features 624 may conform or otherwise align with a shape of one or more surfaces of a can. For example, as shown in FIG. 6C, a shape of the rear locating features 624 may conform to a shape of a surface 626 extending around the can 670.

Figure 6D:
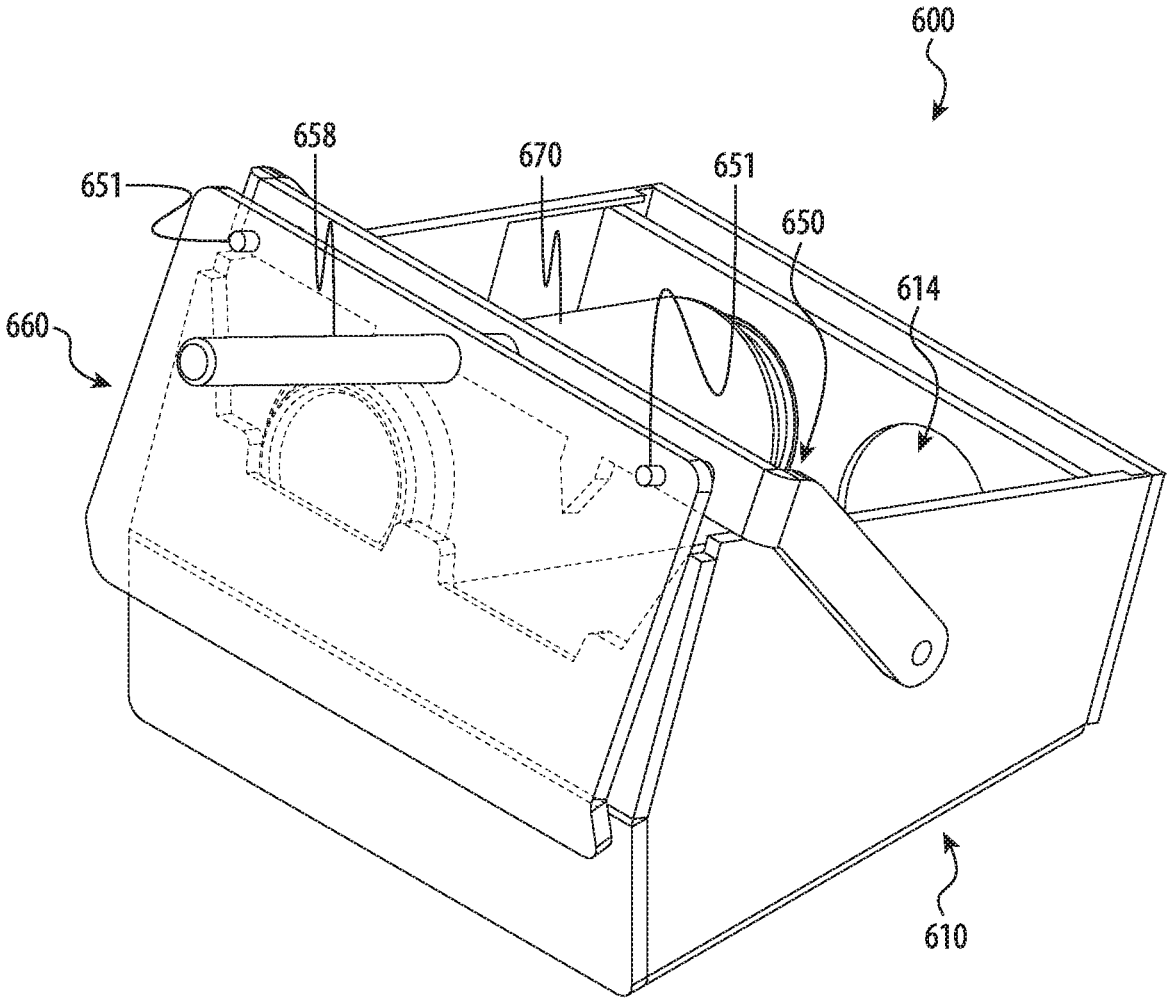

As shown in FIG. 6D, in some embodiments, the puncture device 600 may include one or more shields for preventing liquid or other material from escaping the cavity 614. In some embodiments, a shield 660 may be attached to the pivot arm 650 and may extend from the pivot arm 650 to cover one or more openings when the pivot arm is in the lowered configuration shown in FIG. 6D. The shield 660 may prevent liquid from the can 670 from escaping the cavity 614, for example to shield a user operating the puncture device 600.

In various embodiments, the shield 660 may be formed of any suitable material, In some cases, the shield 660 is formed of a similar material as other components of the puncture device 600, such as the body 610, the pivot arm 650, and the like. In some cases, the shield 660 is formed of a transparent material such as plastic or glass so that a user may see through the shield 660 into the cavity 614.

The shield 660 may be attached to the pivot arm 650 by one or more attachment mechanisms 651. The attachment mechanisms 651 may be any suitable type of fastener. In various embodiments, the shield 660 is removable such that the shield 660 may be removed and replaced without damage to the shield 660. In some cases, the handle 658 may be attached to the shield 660 in addition to or instead of being attached to the pivot arm 650. In some embodiments, the handle 658 serves as an attachment mechanism to attach the shield 660 to the pivot arm 650. In some cases, the handle 658 extends through an opening of the shield 660.

Figure 7:
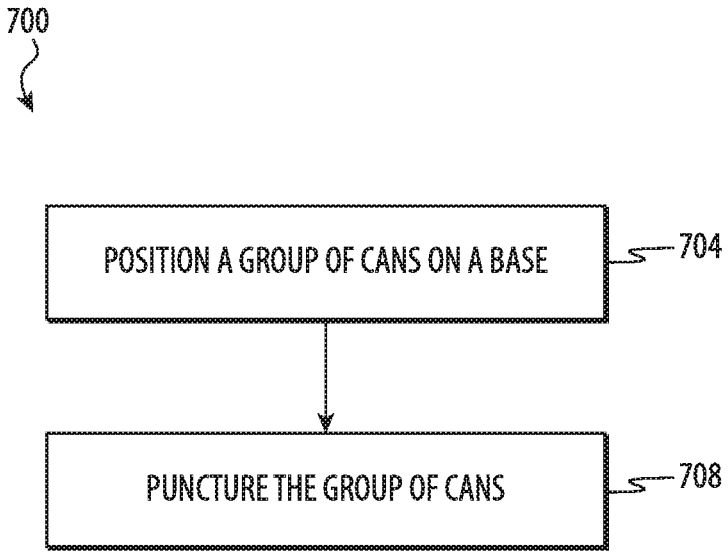
FIG. 7 depicts a flow diagram for a method for puncturing an array of beverage cans.

To facilitate the reader's understanding of the various functionalities of the embodiments discussed herein, reference is now made to the flow diagram in FIG. 7, which illustrates process 700. While specific steps (and orders of steps) of the methods presented herein have been illustrated and will be discussed, other methods (including more, fewer, or different steps than those illustrated) consistent with the teachings presented herein are also envisioned and encompassed with the present disclosure.

FIG. 7 depicts a flow diagram for a method for puncturing multiple cans. The process 700 may be used in conjunction with any of the puncture devices and embodiments described herein (e.g., puncture device 100 of FIG. 1 and the puncture device 600 of FIGS. 6A-6D).

At operation 704, an array of beverage cans may be positioned on a base. For example and with reference to FIGS. 2A-2E, the array of beverage cans 170 may be positioned on the base 110. In some cases, the operation 604 may include arranging each of the array of beverage cans 170 along a row. For example, each of the array of beverage cans 170 may extend between a first sidewall 112*a* and a second sidewall 112*b* of the base 110. As such, a longitudinal axis of each of the array of beverage cans 170 may be offset from one another along the row. The operation 704 may also involve tilting each of the array of beverage cans 170 so that one end of the cans is slightly inclined with respect to the other end of the cans. This may help retain the beverage in the array of beverage cans 170 after they are punctured.

At operation 708, a sidewall of each of the array of beverage cans 170 may be punctured. This may be accomplished by advancing an arm that is pivotally coupled to the base toward the array of beverage cans. For example and with reference to FIGS. 2A-2E, the arm 150 is pivotally coupled with the base 110 of the puncture device 100. The arm 150 includes the array of puncture teeth 162. The array of puncture teeth 162 may have tip portions or points that are used to pierce or initiate a puncture of the respective sidewalls of the array of beverage cans 170. The puncture teeth 162 may also include a tapered portion that expands the initial puncture to define the final shape of the opening. In this regard, the puncture teeth 162 may bend respective sidewalls inward as the arm 150 is advanced, thereby defining the final shape of the opening. In accordance with some embodiments, the arm 150 may be advanced toward the array of beverage cans 170 held on the base 110 such that each of the array of puncture teeth 162 extend into corresponding ones of the array of beverage cans 170. This may form the auxiliary opening 174 in each of the array of beverage cans 170.

In some cases, the method 700 may include rotating a can of an array of beverage cans with a locating feature. This may allow a portion of a first beverage held within the can to be removed. For example and with reference to FIG. 2D, one or more of the array of beverage cans 170 may be rotated along a longitudinal axis. The can may be rotated within one or both of the front locating feature 122 or the rear locating feature 124. The can may be subsequently turned in order to allow a second beverage into the can through a puncture sidewall, such as though the auxiliary opening 174 shown in FIG. 2D.

Other examples and implementations are within the scope and spirit of the disclosure and appended claims. For example, features implementing functions may also be physically located at various positions, including being distributed such that portions of functions are implemented at different physical locations. Also, as used herein, including in the claims, "or" as used in a list of items prefaced by "at least one of" indicates a disjunctive list such that, for example, a list of "at least one of A, B, or C" means A or B or C or AB or AC or BC or ABC (i.e., A and B and C). Further, the term "exemplary" does not mean that the described example is preferred or better than other examples.

The foregoing description, for purposes of explanation, uses specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings.

What is claimed is:

1. A puncture device for producing an auxiliary opening in a beverage can, the puncture device comprising:

a base comprising a set of four sidewalls that define a cavity, the base configured to position an array of beverage cans at least partially within the cavity, each beverage can of the array of beverage cans positioned in an inclined orientation with a top end of the beverage can positioned lower than a bottom end of the beverage can; and an arm pivotally coupled to each of a pair of opposing sidewalls of the set of four sidewalls and extending over the cavity, the arm including a handle and an array of puncture teeth, each puncture tooth of the array of puncture teeth configured to be positioned above a respective beverage can of the array of beverage cans, wherein:

the arm is configured to be manually rotated relative to the base by hand using the handle to drive each puncture tooth of the array of puncture teeth into the respective beverage can to produce the auxiliary opening located proximate to the bottom end of the respective beverage can.

2. The puncture device of claim 1, wherein:

the auxiliary opening is positioned within 40 mm of the bottom end of the beverage can; and the auxiliary opening has a width of at least 5 mm.

3. The puncture device of claim 1, wherein:

a front sidewall of the set of four sidewalls defines an array of locating features; and each locating feature of the array of locating features is configured to allow the respective beverage can of the array of beverage cans to rotate about a longitudinal axis of the respective beverage can in order to remove a portion of liquid contents of the respective beverage can.

4. The puncture device of claim 3, wherein the handle includes an elongaged member that extends outward from a portion of the arm that extends over the cavity.

5. The puncture device of claim 1, wherein:

a front sidewall of the set of four sidewalls extends between the pair of opposing sidewalls;

the front sidewall defines an array of locating features; and each locating feature of the array of locating features is configured to position an end of the respective beverage can of the array of beverage cans.

6. The puncture device of claim 5, wherein each locating feature of the array of locating features defined by the front sidewall elevates the end of the respective beverage can to maintain the inclined orientation.

7. The puncture device of claim 6, wherein the array of locating features are scalloped features.

8. The puncture device of claim 1, wherein each puncture tooth has a tip portion configured to pierce a sidewall of the respective beverage can.

9. The puncture device of claim 1, wherein each puncture tooth has a tapered portion that is configured to deflect a pierced portion of a sidewall of the respective can inward to create the auxiliary opening.

10. The puncture device of claim 1, wherein:

the base defines a capture tray; and the base is configured to hold the array of beverage cans at least partially over the capture tray.

11. The puncture device of claim 10, wherein the capture tray comprises an outlet defining a flow path between the capture tray and an external environment.

12. A puncture device system, comprising:

a puncture device comprising:

a base comprising a set of sidewalls defining a cavity;

an arm pivotally coupled to a pair of opposing sidewalls of the set of sidewalls and extending over the cavity and comprising a first puncture tooth and a second puncture tooth;

a handle attached to the arm along a region of the arm that extends over the cavity;

a first beverage can comprising a first tab positioned at a top end of the first beverage can, the first beverage can positioned in the cavity and aligned with the first puncture tooth; and a second beverage can comprising a second tab positioned at a top end of the second beverage can, the second beverage can positioned in the cavity and aligned with the second puncture tooth; wherein:

the arm is configured to be manually rotated relative to the base by hand using the handle thereby driving the first puncture tooth into the first beverage can to produce:

a first auxiliary opening located proximate to a bottom end of the first beverage can; and a second auxiliary opening located proximate to a bottom end of the second beverage can.

13. The system of claim 12, wherein:

the base comprises:

a first front locating feature;

a second front locating feature;

a first rear locating feature; and a second rear locating feature;

the top end of the first beverage can is positioned in the first front locating feature;

the top end of the second beverage can is positioned in the second front locating feature;

the bottom end of the first beverage can is positioned in the first rear locating feature; and the bottom end of the second beverage can is positioned in the second rear locating feature.

14. The system of claim 12, wherein:

the first tab is configured to form a top opening in the top end of the first beverage can; and the top opening is configured to allow air to flow into the first beverage can while a beverage flows out of the first auxiliary opening.

15. The system of claim 12, wherein the first and second beverage cans are positioned in an inclined orientation.

16. The system of claim 15, wherein the top end of the first beverage can is below the bottom end of the first beverage can.

17. A method for producing auxiliary openings in an array of beverage cans, comprising:

positioning the array of beverage cans in a cavity of a base comprising a set of sidewalls that define the cavity, the positioning the array of beverage cans comprising:

for each beverage can in the array of beverage cans, positioning a bottom end of a beverage can in a front locating feature defined in a front sidewall of the set of sidewalls; and positioning a top end of the beverage can in a rear locating feature defined in a rear sidewall of the set of sidewalls, the top end of the beverage can positioned lower than the bottom end of the beverage can; and manually rotating an arm relative to the base using a hand-operated handle to drive a puncture tooth of an array of puncture teeth into a respective beverage can to produce an auxiliary opening located proximate to the bottom end of the respective beverage can.

18. The method of claim 17, further comprising:

rotating the respective beverage can within the base along a longitudinal axis of the respective beverage can to remove a portion of a first beverage held within the respective beverage can; and pouring a second beverage into the respective beverage can through the auxiliary opening.

19. The method of claim 17, wherein the auxiliary opening is positioned within 40 mm of the bottom end of the beverage can.

20. The method of claim 17, wherein the auxiliary opening has a width of at least 5 mm.

* * * * *